US009907441B2

(12) United States Patent
Osborne, Jr. et al.

(10) Patent No.: US 9,907,441 B2
(45) Date of Patent: Mar. 6, 2018

(54) ELECTRONIC RESIDENTIAL TISSUE DISPENSER

(71) Applicant: VSI IMPORT SOLUTIONS, LLC, Alpharetta, GA (US)

(72) Inventors: Charles Agnew Osborne, Jr., Cumming, GA (US); Tsu- Ling Chang, Worthington, OH (US)

(73) Assignee: VSI Import Solutions, LLC, Alpharetta, GA (US)

( * ) Notice: Subject to any disclaimer, the term of this patent is extended or adjusted under 35 U.S.C. 154(b) by 263 days.

(21) Appl. No.: 14/256,019

(22) Filed: Apr. 18, 2014

(65) Prior Publication Data

US 2015/0297043 A1 Oct. 22, 2015

(51) Int. Cl.

| | |
|---|---|
| ***A47K 10/38*** | (2006.01) |
| ***B65H 16/00*** | (2006.01) |
| ***A47K 10/36*** | (2006.01) |

(52) U.S. Cl.

CPC ..... *A47K 10/38* (2013.01); *A47K 10/3612* (2013.01); *A47K 10/3625* (2013.01); *B65H 16/005* (2013.01); *B65H 2301/41346* (2013.01); *B65H 2402/43* (2013.01); *B65H 2404/143* (2013.01); *B65H 2404/1415* (2013.01); *B65H 2701/1924* (2013.01)

(58) Field of Classification Search

CPC .... A47K 10/36; A47K 10/26; A47K 10/3612; A47K 10/3625; A47K 10/38; B65H 16/005; B65H 2301/41346; B65H 2402/43; B65H 2402/143

See application file for complete search history.

(56) References Cited

U.S. PATENT DOCUMENTS

| | | | |
|---|---|---|---|
| 2,930,663 | A | 3/1960 | Weiss |
| 3,017,131 | A | 1/1962 | Wooster |
| 3,269,592 | A | 8/1966 | Slye et al. |
| 3,288,387 | A | 11/1966 | Craven, Jr. |
| 3,554,456 | A | 1/1971 | Moore |
| 3,594,611 | A | 7/1971 | Tanner et al. |
| 3,628,743 | A | 12/1971 | Bastian et al. |
| 3,858,951 | A | 1/1975 | Rasmussen |

(Continued)

FOREIGN PATENT DOCUMENTS

| | | |
|---|---|---|
| EP | 0574372 | 12/1993 |
| EP | 1097665 | 5/2001 |

(Continued)

OTHER PUBLICATIONS

International Search Report and Written Opinion for related PCT application No. PCT/US2014/019061, dated Jun. 16, 2014.

*Primary Examiner* — Michael E Gallion

(74) *Attorney, Agent, or Firm* — Womble Bond Dickinson (US) LLP

(57) ABSTRACT

An automatic electronic dispenser for dispensing a roll of paper product that avoids refeeding of paper by retarding breaking on the high side of the roll. A dispenser module drives paper from the roll through a discharge chute at the bottom of the module. The dispenser module utilizes two floating pressing rollers and a belt drive that provides quiet and consistent operation by pressing of the two pressing rollers onto a main roll. The dispenser module including a main bar module which holds the roll and which is received on paper holder arms.

19 Claims, 34 Drawing Sheets

(56) References Cited

U.S. PATENT DOCUMENTS 3,885,749 A * 5/1975 Skacel ..... B65H 19/2238 242/413.7
3,917,191 A 11/1975 Graham, Jr. et al.
4,165,138 A 8/1979 Hedge et al.
4,305,525 A * 12/1981 Weigel ..... B65H 3/063 221/1
4,378,912 A 4/1983 Perrin et al.
4,549,664 A 10/1985 Gowan et al.
4,570,197 A 2/1986 Hakanson et al.
4,712,461 A 12/1987 Rasmussen
4,715,086 A 12/1987 Johanson et al.
4,826,262 A 5/1989 Hartman et al.
4,916,613 A 4/1990 Lange et al.
4,960,248 A 10/1990 Bauer et al.
4,981,544 A 1/1991 Nordale
5,007,270 A * 4/1991 Wallis ..... B21D 53/02 226/44
5,031,258 A 7/1991 Shaw
5,060,877 A 10/1991 Bullivant
5,098,078 A * 3/1992 Nakanishi ..... B65H 3/0653 271/10.11
5,131,302 A 7/1992 Watanabe
5,262,229 A 11/1993 Lampert et al.
5,441,210 A 8/1995 Hinton
5,452,832 A 9/1995 Niada
5,491,013 A 2/1996 Holley
5,526,973 A 6/1996 Boone et al.
5,604,992 A 2/1997 Robinson
5,740,006 A 4/1998 Larkin
5,781,942 A 7/1998 Allen et al.
5,857,393 A 1/1999 Kohiayma
5,868,311 A 2/1999 Cretu-Petra
5,878,381 A 3/1999 Gemmell et al.
5,945,910 A 8/1999 Gorra
5,966,753 A 10/1999 Gauthier et al.
5,979,820 A * 11/1999 Yamada ..... G03B 27/588 242/348
6,069,354 A 5/2000 Alfano et al.
6,125,482 A 10/2000 Foster
6,152,445 A 11/2000 Hirota et al.
6,179,243 B1 1/2001 Granger
6,189,163 B1 2/2001 Van Marcke
6,236,953 B1 5/2001 Segal
6,250,601 B1 6/2001 Kolar et al.
6,293,486 B1 * 9/2001 Byrd ..... A47K 10/36 242/563
6,314,971 B1 * 11/2001 Schneider ..... A47K 10/32 134/122 R
6,317,717 B1 11/2001 Lindsey et al.
6,354,533 B1 3/2002 Jespersen
6,411,920 B1 6/2002 McConnell et al.
6,419,136 B2 7/2002 Formon et al.
6,647,242 B2 11/2003 Gagnon et al.
6,736,348 B1 5/2004 Formon et al.
6,871,815 B2 3/2005 Moody et al.
6,915,977 B2 7/2005 Hanzlik et al.
6,952,555 B2 10/2005 Oh et al.
6,974,783 B2 12/2005 Akdogan et al.
7,017,856 B2 3/2006 Moody et al.
7,022,764 B2 4/2006 Murray
7,044,421 B1 5/2006 Omdoll et al.
7,070,203 B2 7/2006 Fisher et al.
7,182,289 B2 2/2007 Moody et al.
7,213,782 B2 5/2007 Osborne et al.
7,296,765 B2 11/2007 Rodrian
7,370,824 B1 5/2008 Osborne
7,698,980 B2 4/2010 Morris et al.
7,783,380 B2 8/2010 York et al.
7,821,155 B2 10/2010 Reinsel et al.
7,845,593 B2 12/2010 Formon et al.
7,946,522 B2 5/2011 Lewis et al.
7,963,475 B2 6/2011 Rodrian
7,967,235 B2 6/2011 Forman et al.
7,980,506 B2 7/2011 Kling et al.
7,984,872 B2 7/2011 Kuehneman et al.
7,987,756 B2 8/2011 Lewis et al.
7,996,108 B2 8/2011 Yardley
8,083,170 B2 12/2011 Troutman et al.
8,162,252 B2 4/2012 Cittadino et al.
8,177,156 B1 5/2012 Rinne
8,229,486 B2 7/2012 Hellstrom
8,418,950 B2 4/2013 Hagleitner
8,439,293 B2 5/2013 Hagleitner
8,448,890 B2 5/2013 Hagleitner
8,496,198 B2 7/2013 Cittadino
8,544,785 B2 10/2013 Pelland
8,600,547 B2 12/2013 Petersen
8,698,333 B2 4/2014 Glasser
8,763,948 B1 7/2014 Holowaty
8,777,149 B2 7/2014 Goeking et al.
8,800,415 B2 8/2014 Osborne
8,807,475 B2 8/2014 Rodrian
2002/0109034 A1 8/2002 Moody et al.
2002/0109035 A1 8/2002 Denen et al.
2002/0150198 A1 10/2002 Thompson et al.
2003/0222779 A1 12/2003 Schotz et al.
2004/0178297 A1 9/2004 Moody et al.
2005/0018375 A1 1/2005 Takayanagi
2005/0167541 A1 8/2005 Osborne
2007/0176041 A1 8/2007 Friesen et al.
2008/0100982 A1 5/2008 Lewis et al.
2008/0245922 A1 * 10/2008 Fellhoelter ..... A47K 10/36 242/554.6
2009/0057478 A1 * 3/2009 Conner ..... A47K 10/36 242/564
2010/0044407 A1 * 2/2010 Yardley ..... B65H 35/0006 225/14
2011/0253829 A1 10/2011 Goeking et al.
2012/0019495 A1 1/2012 Chang et al.
2012/0312853 A1 12/2012 Osborne et al.
2013/0096729 A1 4/2013 Wegelin
2013/0334357 A1 * 12/2013 Huruse ..... A47K 10/34 242/562.1
2014/0158809 A1 * 6/2014 Borke ..... A47K 10/3687 242/563
2015/0157177 A1 * 6/2015 Carper ..... A47K 10/3656 242/570

FOREIGN PATENT DOCUMENTS

EP 2377442 10/2011
JP 2010233971 10/2010

* cited by examiner

FIG. 26A
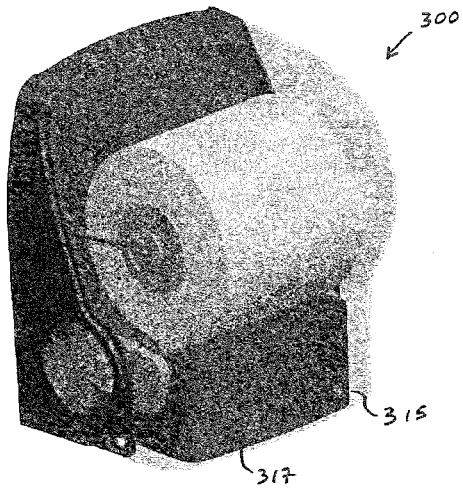
FIG. 26C
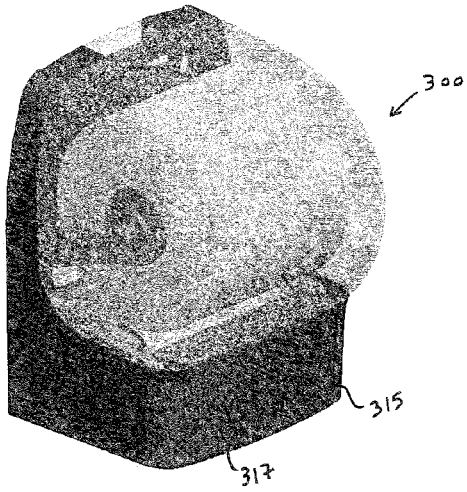
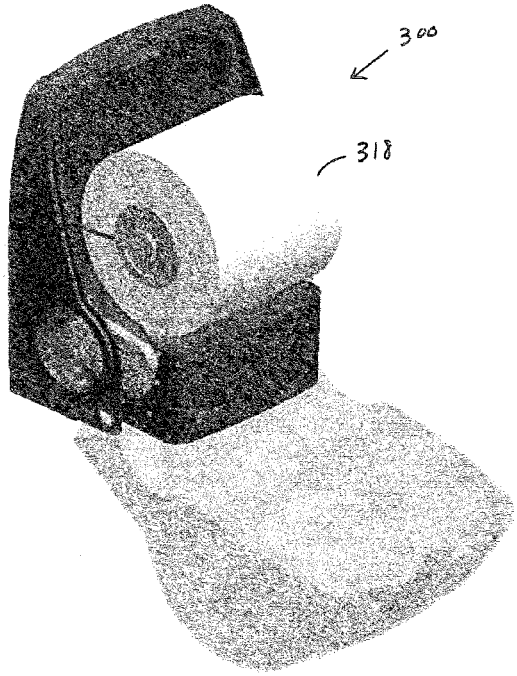
FIG. 26B
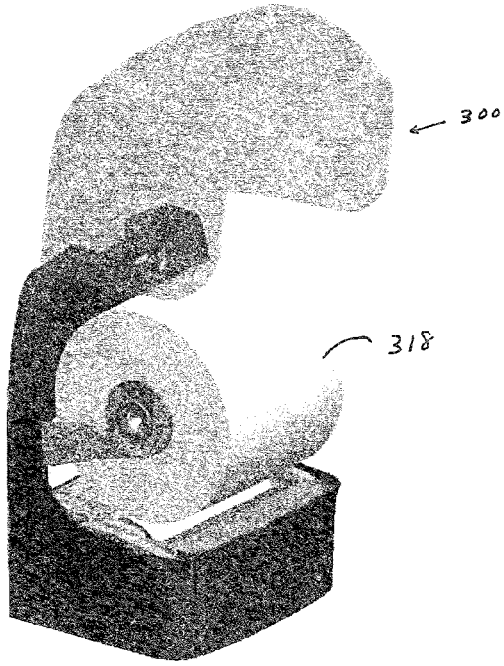
FIG. 26D

300

ELECTRONIC RESIDENTIAL TISSUE DISPENSER

TECHNICAL FIELD

Embodiments of the invention relate generally to tissue dispensing mechanisms and, more particularly, to electronic tissue dispensing systems for perforated flexible sheet material.

BACKGROUND

The dispensing of paper products has resulted in many different types of dispensing devices for controlling quantities dispensed as well as for determining how efficiently the paper products are dispensed. Primarily, these dispensers use mechanical paper feeding mechanisms, actuated by the user physically touching the dispenser equipment to deliver a fixed length of paper. This bodily contact can raise concerns over hygiene when such dispensers are located in public restroom facilities.

Commercial dispensing devices for separating a continuous roll of tissue paper typically include a pair of arms for supporting the roll of tissue. Such devices include a driving roller and a pressing roller for pulling the tissue down through the dispenser throat. A cutting blade can cut the toilet paper when the paper is pulled by the user. Dispensing devices for separating a continuous roll of tissue paper with tear lines (i.e., perforations) typically drive the tissue through the dispenser so that the user tears the tissue paper along the tear lines.

The use of electronic dispensers is becoming more prevalent especially in public restroom facilities where the electronic dispensers can dispense a measured length of towel sheet material upon sensing the presence of a user. In such "hands free" operation, the user does not manually activate or otherwise contact the dispenser in order to initiate a dispense cycle. However, the thinness of tissue sheet material has generally prevented the use of electronic dispensers for either public-use or residential dispensing equipment because the dispensing equipment will stop functioning if the perforated tissue breaks inside the dispenser.

In addition, conventional electronic dispensers accumulate and discharge static electricity during the dispense cycle. Static charge can be generated by various components or operations such as the movement of sheet material over rollers, interactions between rollers, etc. If the static charge is not dissipated, the user may receive a static shock if he touches the dispenser during use. The static charge can adversely affect the electronic control and sensor circuitry in the dispenser.

SUMMARY

In one embodiment, an electronic tissue dispenser is provided for dispensing tissue sheet material, for example, perforated tissue or other paper materials. A dispenser housing contains a support mechanism for holding at least one roll of tissue sheet material, and includes a base for mounting to a surface, a cover pivotally mounted to the base, and a discharge chute formed within the housing for discharging the tissue sheet material from the dispenser. A control circuit in the housing can control dispensing of the sheet material from the housing. A dispensing mechanism can drive tissue sheet material from the housing upon receiving a signal from the control circuit. The dispenser can include an adjustable proximity sensor. The dispensing mechanism is operative to be responsive to a signal from the proximity sensor to dispense a sheet of material.

In one embodiment, an automatic electronic dispenser for dispensing a roll of perforated paper sheet materials includes a dispenser module for driving paper from the roll through a discharge chute at the bottom of the module. A front cover hinged on each side rotates to an open position for loading a paper roll. A back cover enables mounting the electronic dispenser to a vertical surface such as a wall. The dispenser module includes a paper roll holder attached to the sides of the dispenser module; a driving roller for unrolling the perforated paper material from the paper holder in response to a signal from an electronic sensor; and a plurality of pressing rollers, the pressing rollers engaging the driving roller as the perforated paper materials are being dispensed along a path between the pressing and driving rollers to a discharge chute.

In another embodiment, an automatic electronic dispenser for dispensing a roll of paper product includes a dispenser module for driving paper from the roll through a discharge chute at the bottom of the module. The dispenser module includes a holder support mechanism secured to a dispenser frame; a paper roll holder mechanism including a plurality of paper holder arms attached to opposite ends of the holder support mechanism, the paper holder arms shaped to fit into a core of the paper roll; a driving roller for unrolling the paper from the paper holder in response to a signal from an electronic sensor; and a plurality of belt-driven pressing rollers, the pressing rollers engaging the driving roller to dispense paper along a path between the pressing and driving rollers to a discharge chute.

In yet another embodiment, an automatic electronic dispenser for dispensing a roll of paper product that generally avoids a need for refeeding of the paper product into the dispenser prior to replacement of a spent roll by retarding breaking or premature tearing of the paper, such as along preformed perforations or other lines of separation on the high side of the roll is provided. A dispenser module drives paper from the roll through a discharge chute at the bottom of the module. The dispenser module utilizes drive roller drivers by operation of a drive motor and two floating pressing rollers driven by the drive roller via a belt drive arrangement that provides quiet and consistent operation of the pressing rollers in conjunction with the drive roll, with the perforated sheet material being positively drawn therebetween so as to further help avoid breaking or tearing of the paper sheets, such as along perforations therebetween. The dispenser module including a main bar module which holds the roll and which is received on paper holder arms.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings as follows:

FIGS. 26A-26D illustrate the electronic residential dispenser module of the embodiment of FIG. 25 showing different configurations of hingeable covers.

DETAILED DESCRIPTION

Figure 1:
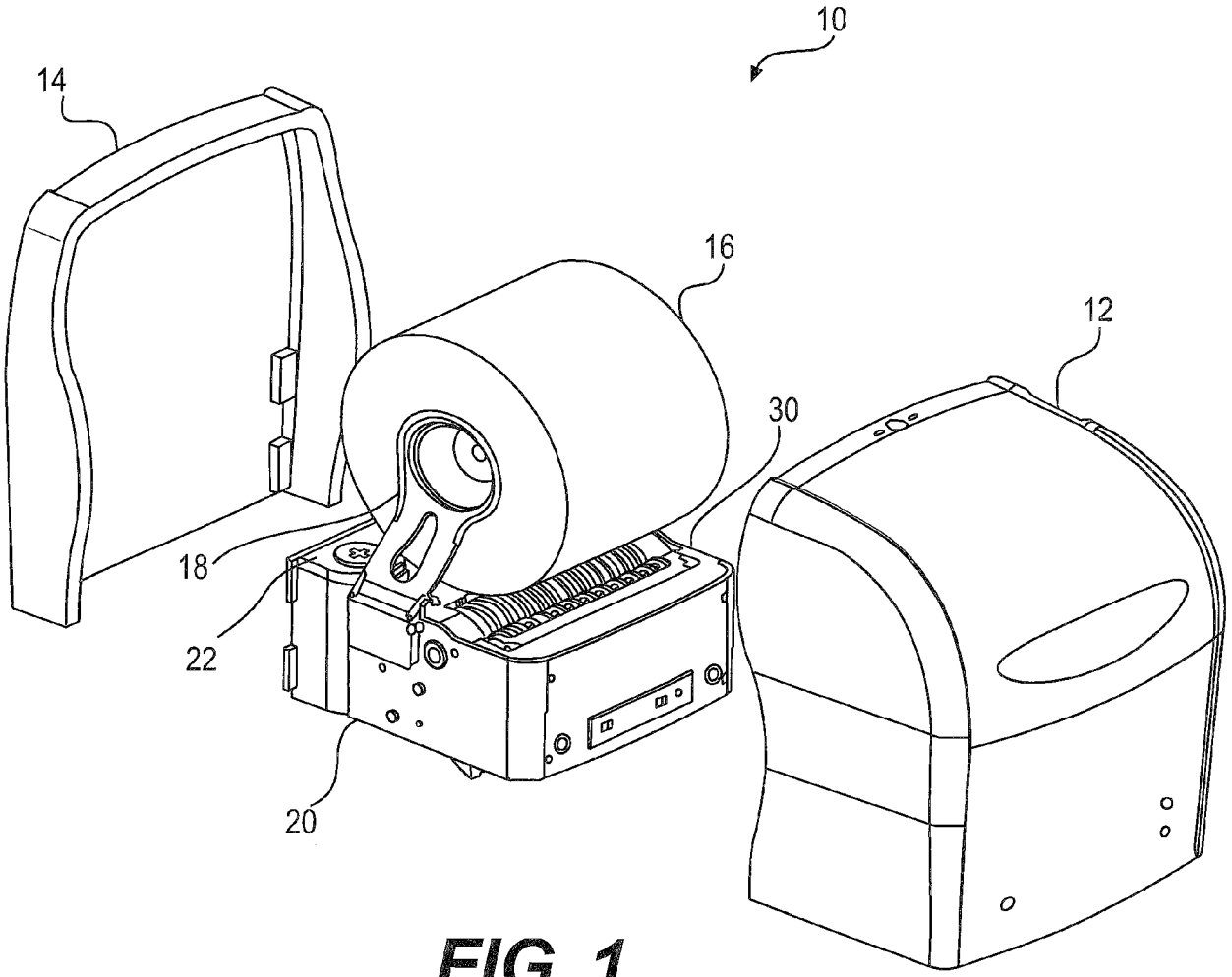
FIG. 1 illustrates an isometric view of components of the electronic residential dispenser with front and back covers removed in an exemplary embodiment.

The following description is provided as an enabling teaching of embodiments of the invention. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

The embodiments described may utilize concepts disclosed in commonly-owned patents U.S. Pat. No. 7,213,782 entitled "Intelligent Dispensing System" and U.S. Pat. No. 7,370,824 entitled "Intelligent Electronic Paper Dispenser," both of which are incorporated by reference herein. The embodiments may also utilize concepts disclosed in published patent application US 2008/0100982 entitled "System and Method for Dissipating Static Electricity in an Electronic Sheet Material Dispenser" and incorporated by reference herein.

The dispenser in the disclosed embodiments may also be referred to herein as the electronic residential tissue dispenser (ERTD) although the disclosed embodiments of the dispenser are also suitable for public or commercial uses.

In one embodiment, a dispenser is provided for controlled dispensing of rolled sheet materials, for example, tissue paper sheets or other, similar materials that can have a series of perforations or other lines/areas of separation. It thus will be understood that while the present embodiment is shown for use in feeding tissue paper, other sheet materials also can be fed using the present dispenser. In the illustrated embodiments, the tissue paper roll can sit on the dispenser arms in a manner similar to that of towel dispensers currently available. When the user pulls tissue paper from the roll (manual operation), the tissue paper is pulled by the large driving roller through the two small pressing rollers. The problem with tissue paper is that it typically is perforated so as to define discrete size sheets. With the current design of towel dispensers is modified for use as a tissue dispenser, if the user pulls tissue and the perforation breaks above the pressing roller, the paper can no longer feed. The paper will not feed unless the dispenser unit "rolls the roll" as disclosed in U.S. Pat. No. 7,213,782 and U.S. Pat. No. 7,370,824. However, a more cost-effective design for tissue dispensing is provided by the disclosed embodiments having at least double pressing rollers. If the perforation tears between the two pressing rollers the dispenser will continue to self-feed in both manual and automatic operation (using infrared sensors to trigger tissue dispensing).

The embodiments disclosed are suitable for both residential and commercial use. The use of double pressing rollers is unique in dispenser mechanisms. Other tissue dispensers function like the commercially available paper towel dispensers. If a perforation is read when paper is being dispensed, the dispenser re-feeds the perforated sheet and then sets the tissue so that it tears on the other side of the pressing roller.

In the exemplary embodiments, perforations are not necessarily shown since it does not matter where the perforation is because of the double pressing rollers. Unless the tissue breaks above the top pressing roller, the tissue in the dispenser is always self-feeding. The tissue paper is always re-fed automatically through the driving roller and the dual pressing rollers.

FIG. 1 illustrates an isometric view of components of the electronic residential dispenser with front and back covers removed in an exemplary embodiment. In this embodiment, the electronic residential dispenser 10 includes an electronic residential dispenser module 20, a rear cover 14 that can be mounted to a wall, a front cover 12, a roll of perforated tissue paper mounted between a pair of paper holder arms 18, battery compartment lid 22, and roller assembly 30. The roller assembly including the driving roller and dual pressing rollers is described in detail herein. Although this embodiment is intended for mounting to a wall in a residential bathroom, other embodiments may use other types of mounts including a pedestal mount. This embodiment can also be installed in a commercial restroom modified to accept alternating current power instead of battery power.

Figure 2:
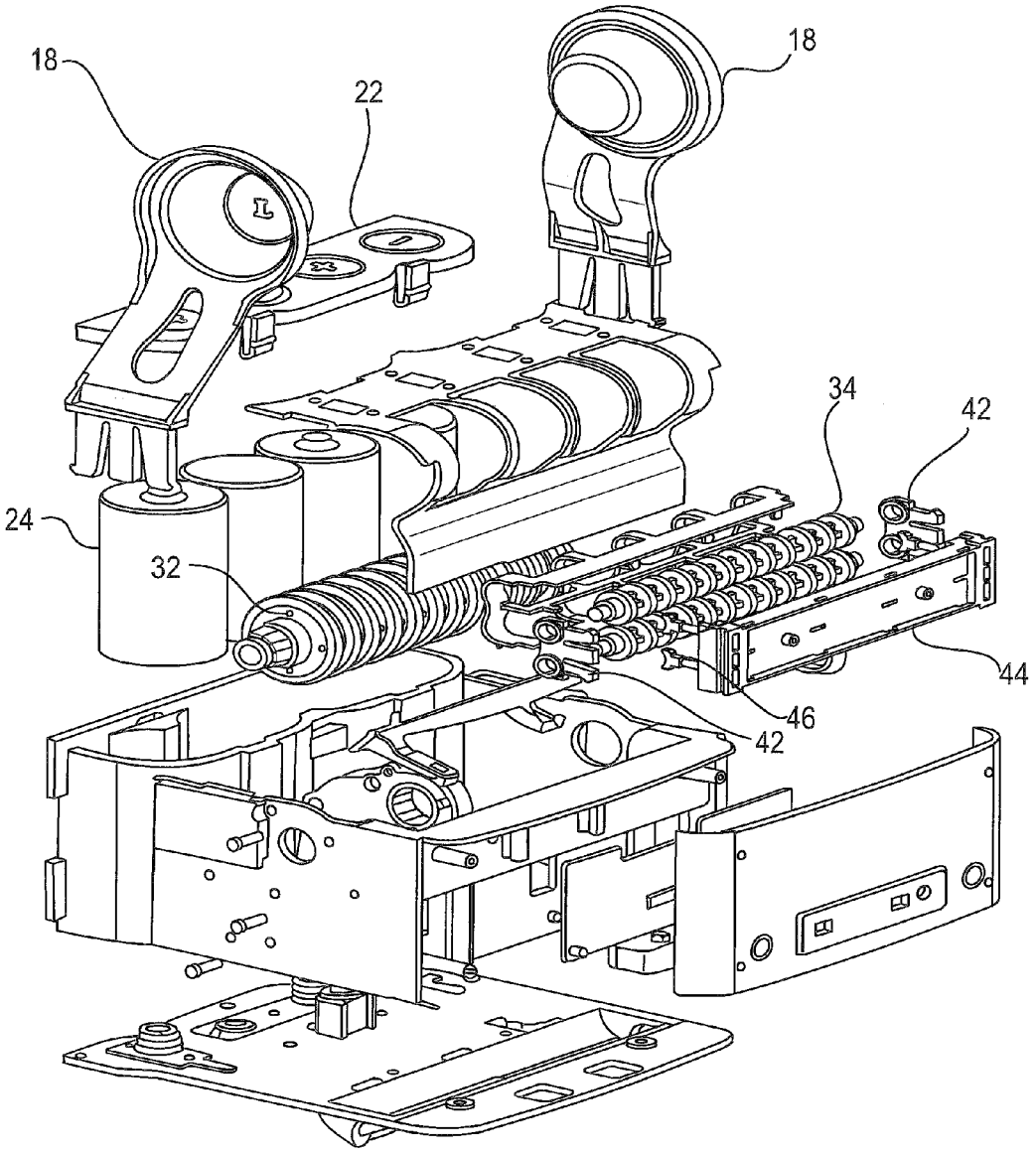
FIG. 2 illustrates an exploded isometric view of the components of the electronic residential dispenser in an exemplary embodiment.

FIG. 2 illustrates an exploded isometric view of the components of the electronic residential dispenser in an exemplary embodiment. The components shown include driving roller 32, dual pressing rollers 34, paper holder arms 18, battery lid 22, batteries 24, and various frame components. The dual pressing rollers 34 are mounted between end mounts 42 and to frame 42 by front mounts 46. The dual pressing rollers 34, driving roller 32, and most components of electronic residential dispenser 10 can be made from a plastic or synthetic material, such as an ABS plastic, although other materials may be used in other embodiments.

In the prior art, paper dispensers use a single pressing roller. However, with a single pressing roller, the user can tear the paper and the perforation may break inside the rollers. In the exemplary embodiment of FIG. 2, the two pressing rollers 34 are spring-loaded ABS rollers. The two pressing rollers 34 press against the driving roller 32. The two pressing rollers are also referred to herein as double or dual pressing rollers. Both pressing rollers 34 press against the driving roller 32 when tissue is being dispensed. This allows the dispenser mechanism to prevent tissue perforations from tearing above the second pressing roller. If the perforation ever breaks between the pressing rollers, the tissue paper will continue to feed.

In an exemplary embodiment, the electronic tissue paper dispenser has standard arms for holding the roll of tissue paper. The double pressing rollers may also be referred to as double feeding rollers. In contrast to automatic tissue dispensers in the art which include a tear bar or similar mechanism to cut paper towel, the disclosed embodiments do not have or need a tear bar. Instead a flapper bar is located at the bottom of the discharge chute (dispenser throat). The significance of having two rollers pressing on the driving roller is that if the perforations ever break on the upstream side of the second pressing roller, the second pressing roller continues to feed the paper. If the perforation breaks on the discharge side, the paper will continue to feed when requested by the user.

Figure 3:
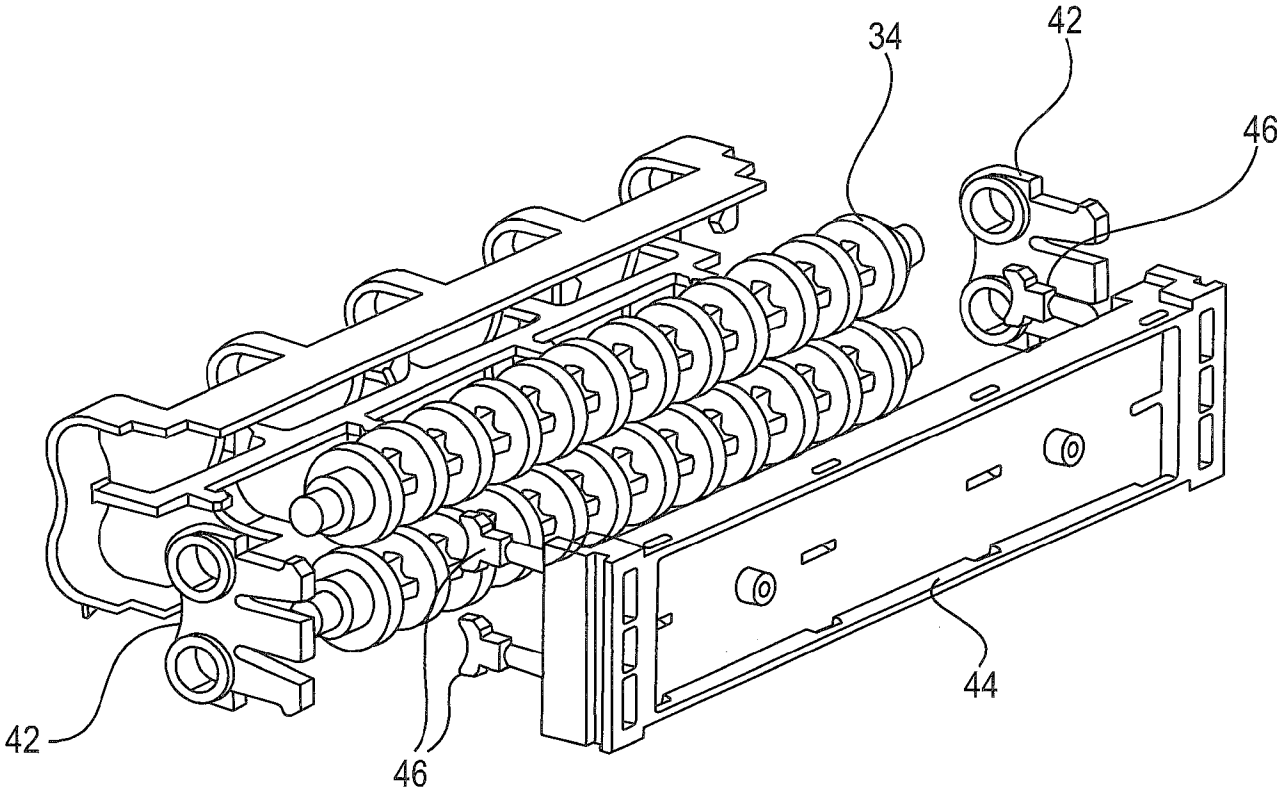
FIG. 3 illustrates an exploded view of the dual driving roller assembly in an exemplary embodiment.

FIG. 3 illustrates an exploded view of the dual driving roller 34 assembly in an exemplary embodiment. The figure shows the dual pressing rollers 34, end mounts 42, front frame part 44, and a plurality of mounts 46 for securing frame part 46 to the dual pressing rollers 34.

Figure 4A:
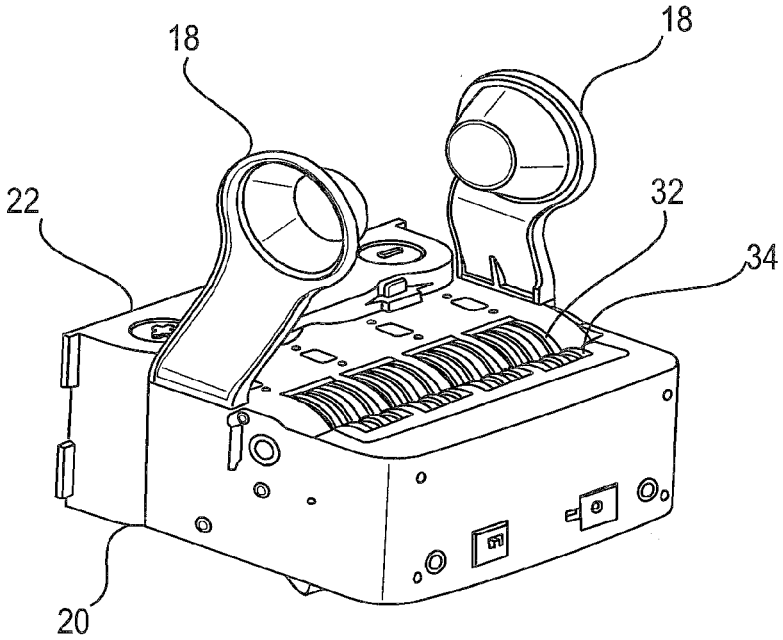
FIGS. 4A-4B illustrate external isometric front and bottom views of the residential electronic dispenser in an exemplary embodiment.
Figure 4B:
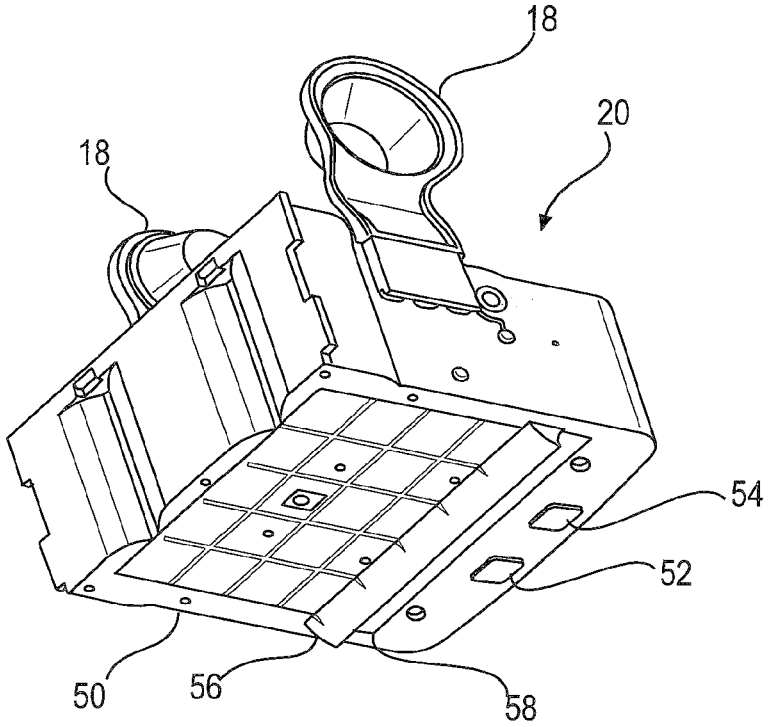

FIGS. 4A-4B illustrate external isometric front and bottom views of the residential electronic dispenser in an exemplary embodiment. The front isometric view of FIG. 4A shows the paper holder arms 18, the battery compartment lid 22, the driving roller 32, and the upper pressing roller 34 of residential electronic dispenser 20. FIG. 4B shows bottom surface 50, cutting bar 56, and proximity sensors 52, 54 which detect the presence of a user's hand below the throat 58 of the dispenser 20. In one embodiment, the proximity sensors may include an infrared emitter and an infrared receiver. A flapper bar 56 is located adjacent the discharge chute (throat) 58 of the dispenser 20 for removing the perforated tissue paper hanging below the discharge chute 58.

Figure 5B:
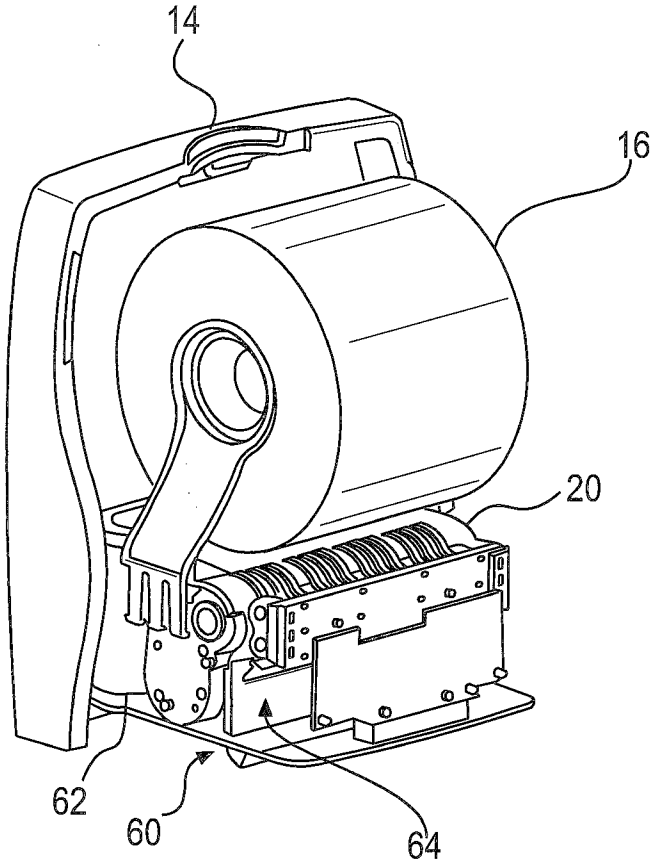
FIGS. 5A-5B illustrate the electronic residential dispenser module supporting a roll of electronic tissue between a pair of paper holder arms showing the location of a static release inside in an exemplary embodiment.
Figure 5A:
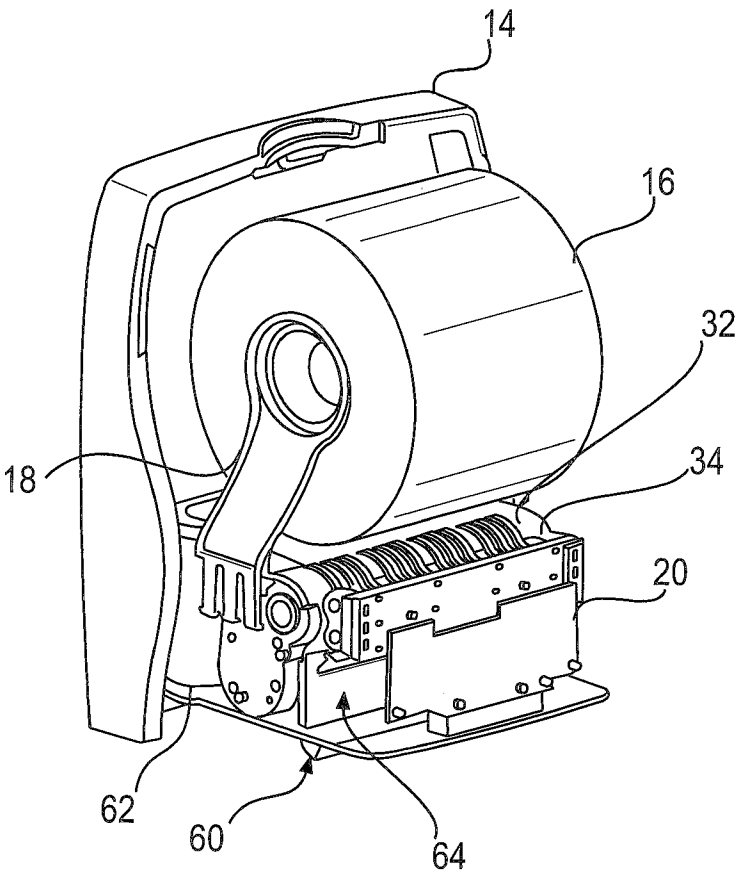

FIGS. 5A-5B illustrate the electronic residential dispenser module supporting a roll of tissue paper between a pair of paper holder arms showing the location of a static release inside in an exemplary embodiment. FIG. 5A shows the roll of tissue paper 16 which may be perforated held in place by paper roll holder 18. Also shown is driving roller 32 contacting pressing roller 34. FIG. 5B shows an interior portion of the electronic residential dispenser module 20 including a static release 60. Static is released from the bottom of the module 20. The dual rollers solve the paper break problem inside the dispenser module. The batteries that provide power for operation of the dispenser are loaded in the battery compartment on the back part of the dispenser. The static release is from the bottom of the dispenser module.

Figure 6B:
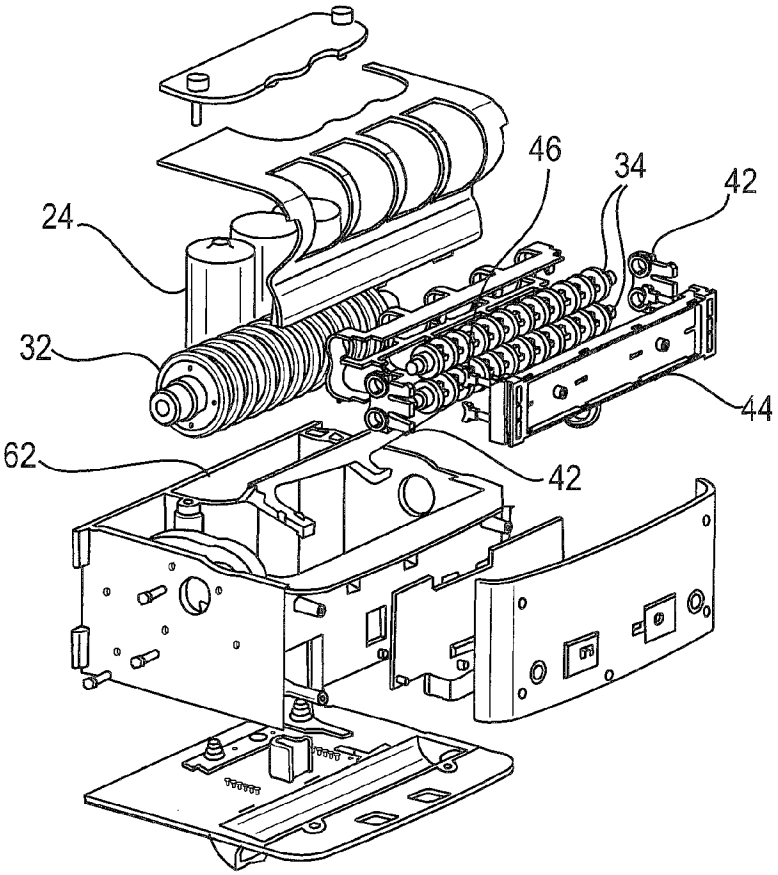
FIGS. 6A-6B illustrate the electronic residential dispenser module with the paper holder arms removed and an exploded view of the module frame and other components in an exemplary embodiment.
Figure 6A:
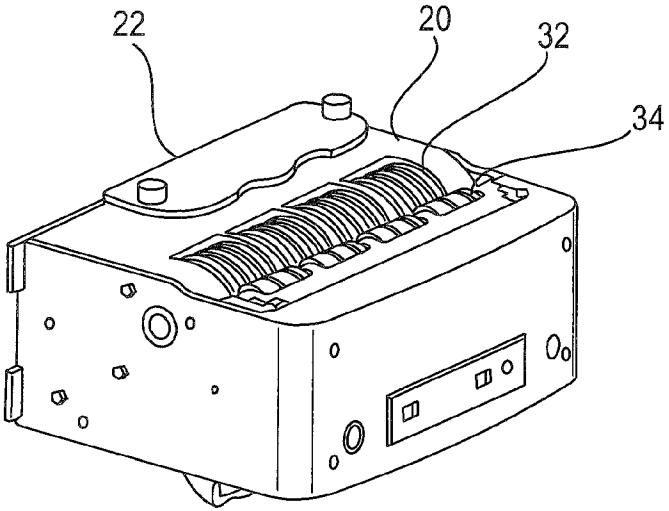

FIGS. 6A-6B illustrate the electronic residential dispenser module with the paper holder arms removed and an exploded view of the module frame and other components in an exemplary embodiment. FIG. 6A shows the position of battery compartment lid 22 covering the battery compartment of residential dispenser module 20 and the top parts of the driving roller 32 and the upper pressing roller of dual pressing roller 34. The exploded view of the module frame in FIG. 6B also shows battery compartment 62, batteries 24, driving roller 32, dual pressing rollers 34, end mounts 42, front frame part 44, and a plurality of mounts 46 for securing frame part 46 to the dual pressing rollers 34.

Figure 7B:
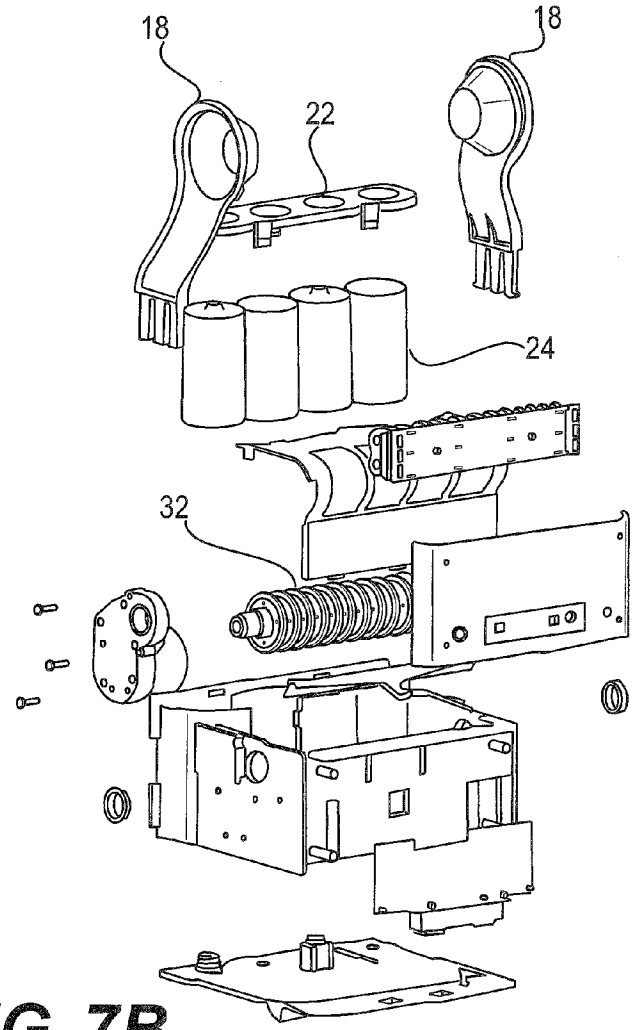
FIGS. 7A-7B illustrate the electronic residential dispenser module with the paper holder arms installed and an exploded view of the module frame and other components in an exemplary embodiment.
Figure 7A:
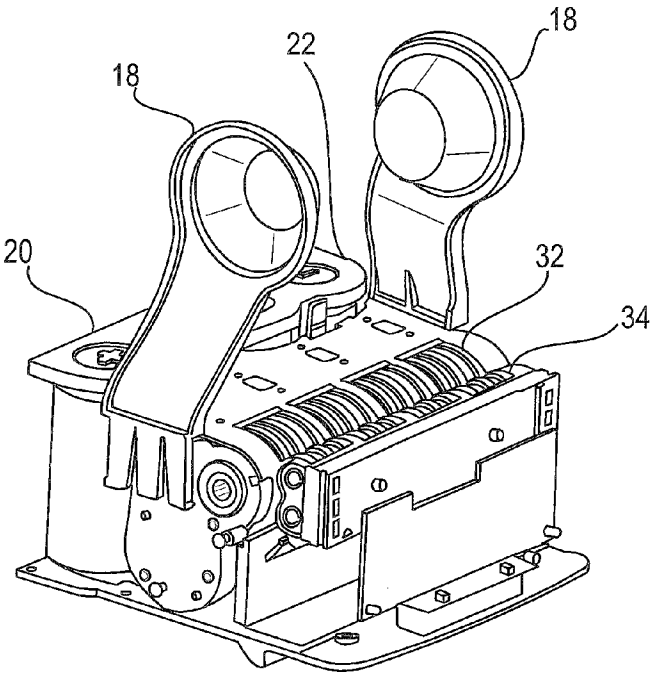

FIGS. 7A-7B illustrate the electronic residential dispenser module with the paper holder arms installed and an exploded view of the module frame and other components in an exemplary embodiment. FIG. 7A shows the attachment of the paper holder arms to the electronic residential dispenser module 20. In one embodiment, the paper holder arms 18 may be similar to paper holder arms used to support heavier sheet material such as paper towels. The driving roller 32, pressing roller 34, and battery compartment lid of electronic residential dispenser module 20 are also shown in this drawing. FIG. 7B shows an exploded view of the module frame in addition to driving roller 32, battery compartment lid 22, batteries 24, and paper holder arms 18.

Figure 8:
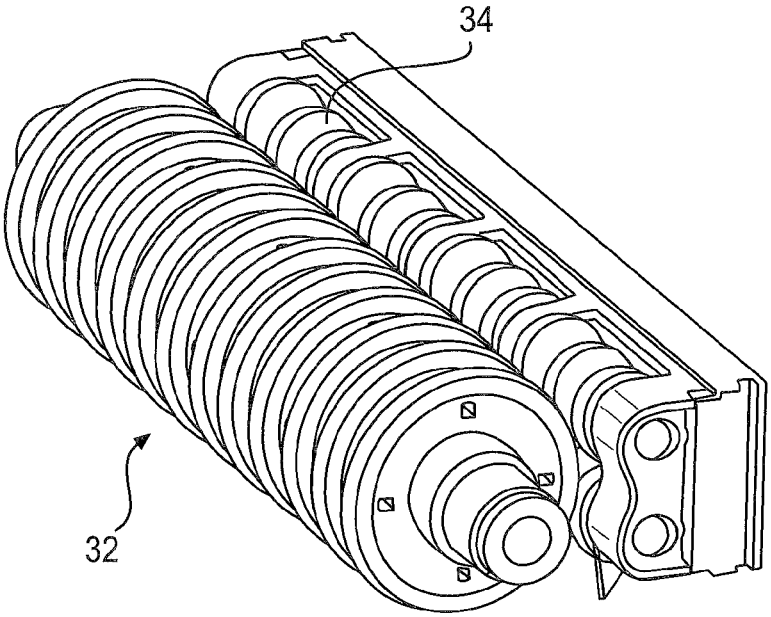
FIG. 8 illustrates the driving roller and dual pressing rollers in physical contact with each other in an exemplary embodiment.

FIG. 8 illustrates the driving roller 32 and dual pressing rollers 34 in physical contact with each other in an exemplary embodiment. In operation, as the rollers 32, 34 rotate, the tissue paper is dispensed from the roll held by paper holder support arm 18 and driven between the rollers 32, 34 to the dispenser exit. If the tissue paper breaks at a perforation between the two pressing rollers 34, the tissue paper will continue to automatically feed to the dispenser exit.

Figure 9:
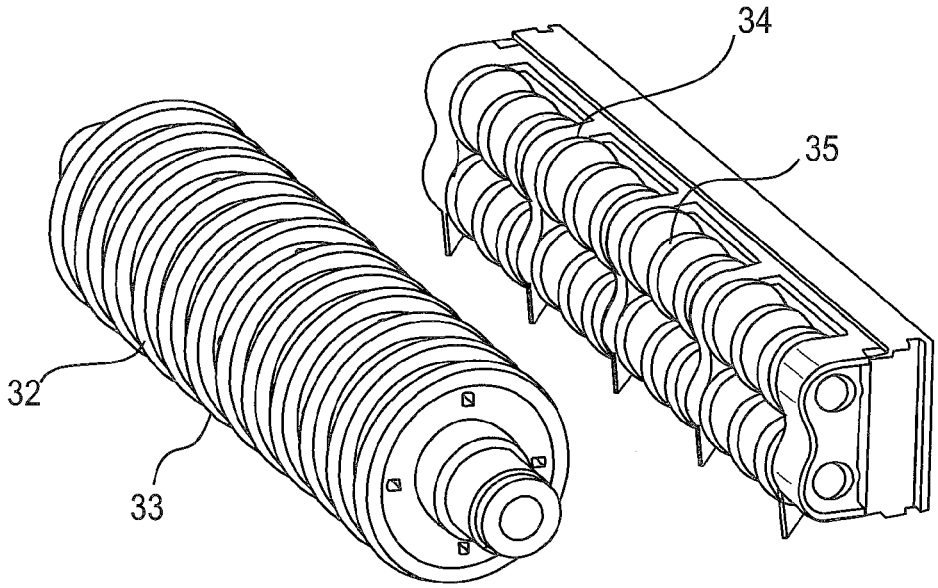
FIG. 9 illustrates the separate driving roller and dual pressing roller components in an exemplary embodiment.

FIG. 9 illustrates the separate driving roller 32 and dual pressing roller 34 components in an exemplary embodiment. In the embodiment shown, both driving roller 32 and pressing rollers 34 include a series of evenly-spaced annular ridges 33, 35, respectively, on the periphery of each roller. As the rollers 32, 34 are activated to dispense tissue paper 16 between them; the ridges 33, 35 make contact with the tissue paper 16 as the rollers rotate to drive the tissue paper through the discharge chute. In other embodiments, the driving and dual pressing rollers may be fabricated without ridges (i.e., continuous outer surface) on the periphery of each roller.

Figure 10B:
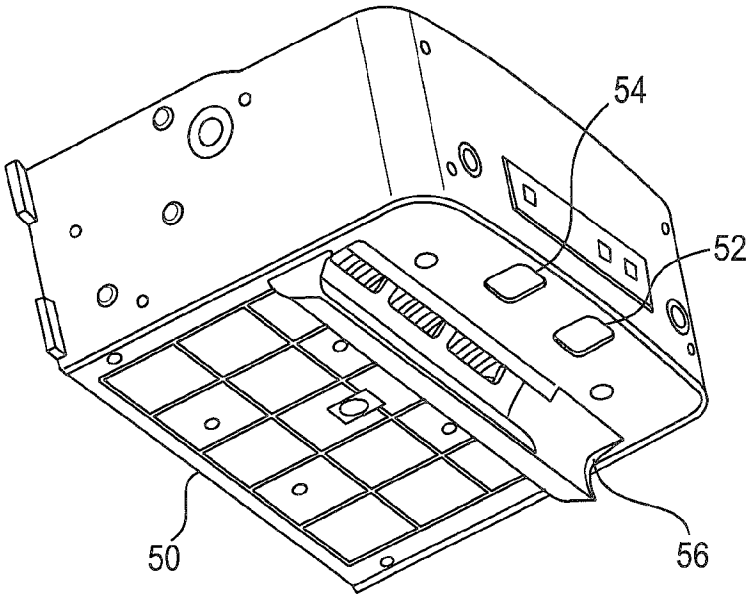
FIGS. 10A-10B illustrate front and bottom isometric views of the electronic residential dispenser module in an exemplary embodiment.
Figure 10A:
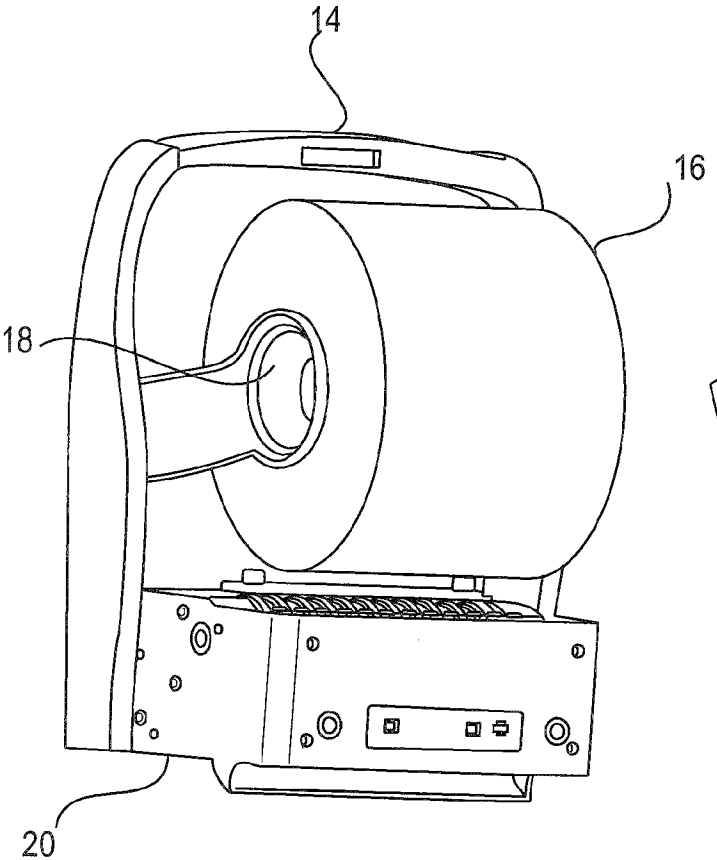

FIGS. 10A-10B illustrate front and bottom isometric views of the electronic residential dispenser module in an exemplary embodiment. FIG. 10A shows the electronic residential dispenser with the front cover removed. The components depicted include dispenser module 20, tissue paper roll 16, paper holder support arm 18, and rear cover 14. FIG. 10B shows bottom surface 50 and proximity sensors 52, 54 which detect the presence of a user's hand below the throat 58 of the dispenser 20. In one embodiment, the proximity sensors may include an infrared emitter and an infrared receiver.

Figure 11:
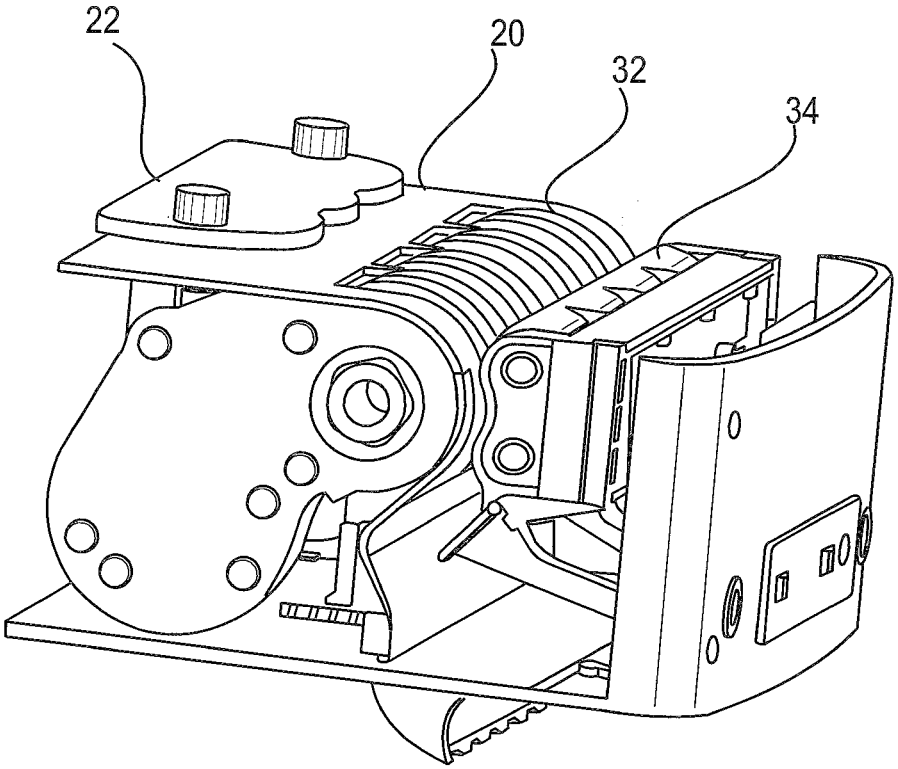
FIG. 11 illustrates an isometric side view of the electronic residential dispenser module with the cover and paper holder arms removed in an exemplary embodiment.

FIG. 11 illustrates an isometric side view of the electronic residential dispenser module with the cover and paper holder arms removed in an exemplary embodiment. FIG. 11 shows driving roller 32, dual pressing rollers 34, and battery compartment cover 22.

Figure 12B:
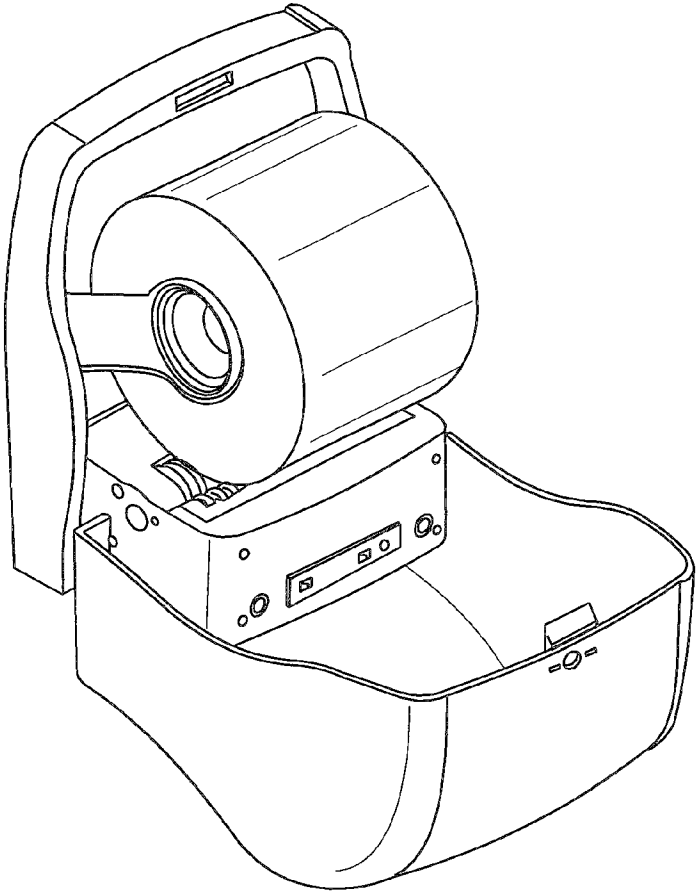
FIGS. 12A-12B illustrate an isometric view of the electronic residential dispenser module with the cover closed and with the cover opened in an exemplary embodiment.
Figure 12A:
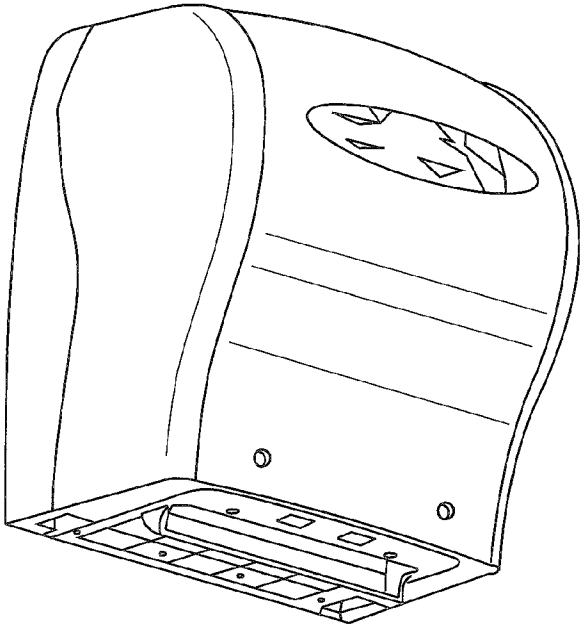

FIGS. 12A-12B illustrate an isometric view of the electronic residential dispenser module with the cover closed and with the cover opened in an exemplary embodiment. As shown in these figures, the electronic residential dispenser module 20 is fixed relative to the frame support.

Parent patent application Ser. No. 13/842,343, filed Mar. 15, 2013, describes and illustrates an alternate embodiment of the electronic tissue dispenser in which electronic residential dispenser module has a swivel portion that opens for weight when the front cover is opened. The parent application Ser. No. 13/842,343, as amended on Jul. 10, 2013 and Nov. 4, 2013, is hereby incorporated by reference in its entirety herein.

Figure 13:
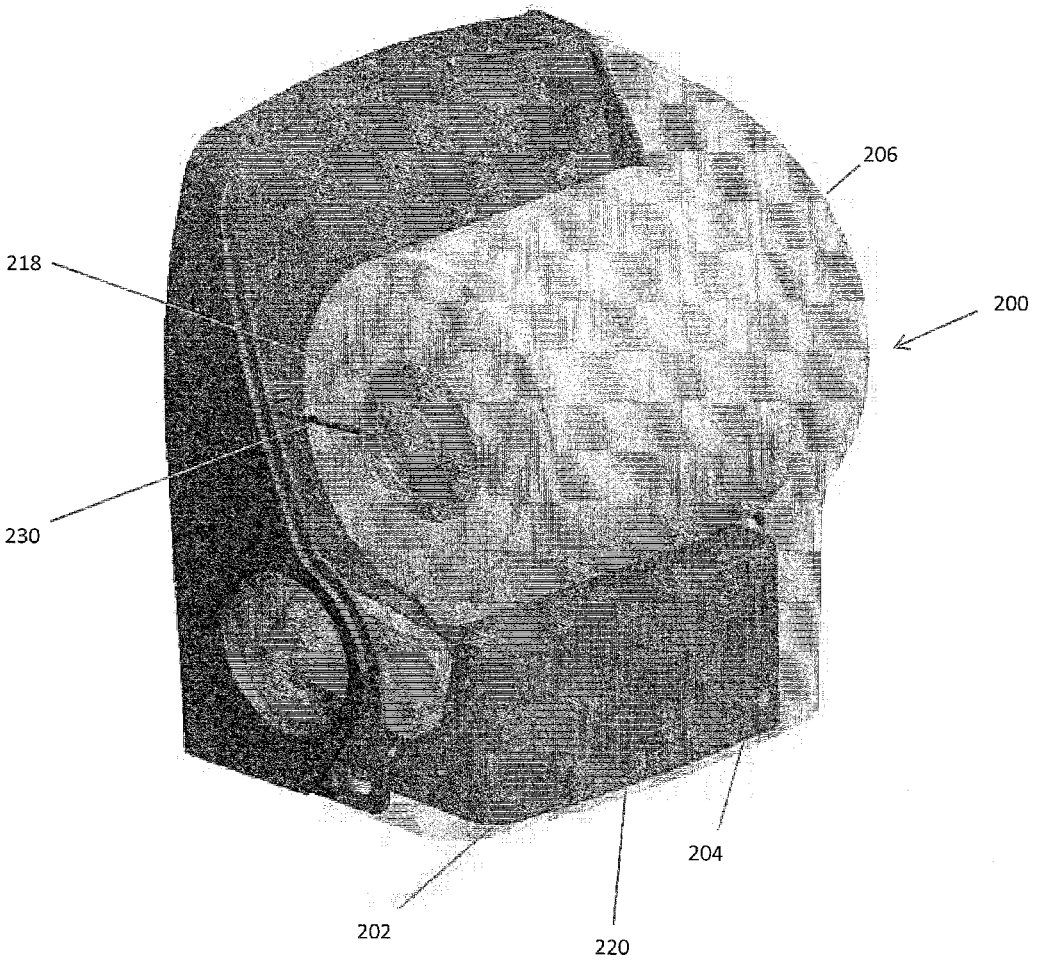
FIG. 13 illustrates an isometric view of an electronic residential dispenser in a closed position in an alternate embodiment.

FIG. 13 illustrates an isometric view of an additional embodiment of an electronic residential dispenser 200, shown in a closed position, which dispenser can operate on standard alkaline battery cells or other, similar power source so as to enable the dispenser to be a portable or stand-alone unit as needed. Low power light 202 and manual button 204 are shown on the front of the dispenser module 220. Dispenser cover 206 can be fabricated from a lightweight, low cost plastic material such as a clear ABS plastic, or other, similar material. The core of a paper roll such as a perforated tissue or other rolled paper material, is mounted on paper roll holders 218 which are mounted to formed circular clamps at opposite ends of a U-shaped holder support mechanism 230 which, in turn, is mounted to brackets on the rear vertical portion of dispenser module 220. Although this embodiment could be mounted to a wall in a residential bathroom, other types of mounts could be used including a pedestal mount. This embodiment can also be installed in a commercial restroom modified to accept alternating current power instead of battery power.

Figure 14:
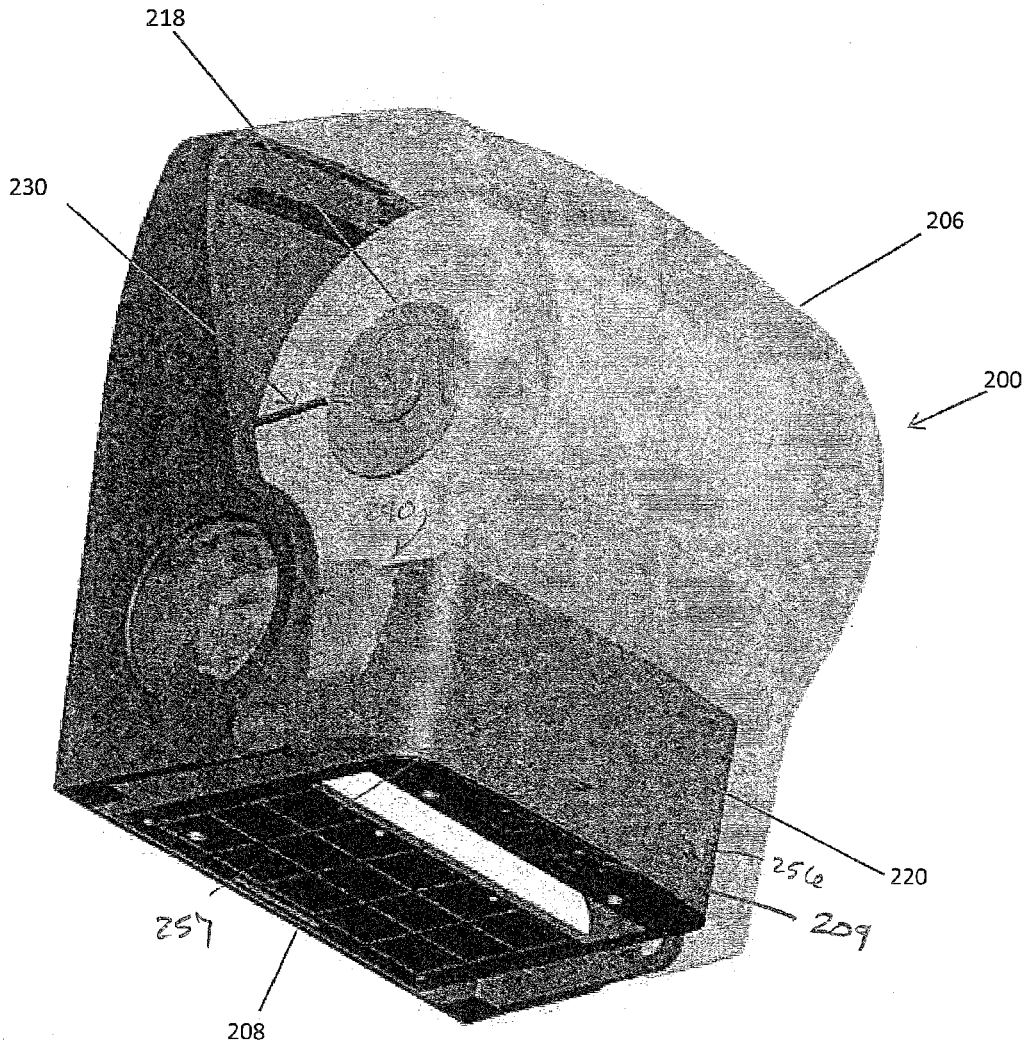
FIG. 14 illustrates a bottom isometric view of an electronic residential dispenser module with in an alternate embodiment.

FIG. 14 illustrates a bottom isometric view of the electronic residential dispenser module of FIG. 13. FIG. 14 shows bottom surface 208. Proximity sensors, for example being located at areas such as indicated at 209, can detect the presence of a user's hand below the throat of the dispenser module 220. In one embodiment, the proximity sensors may include an infrared emitter and an infrared receiver.

Figure 15A:
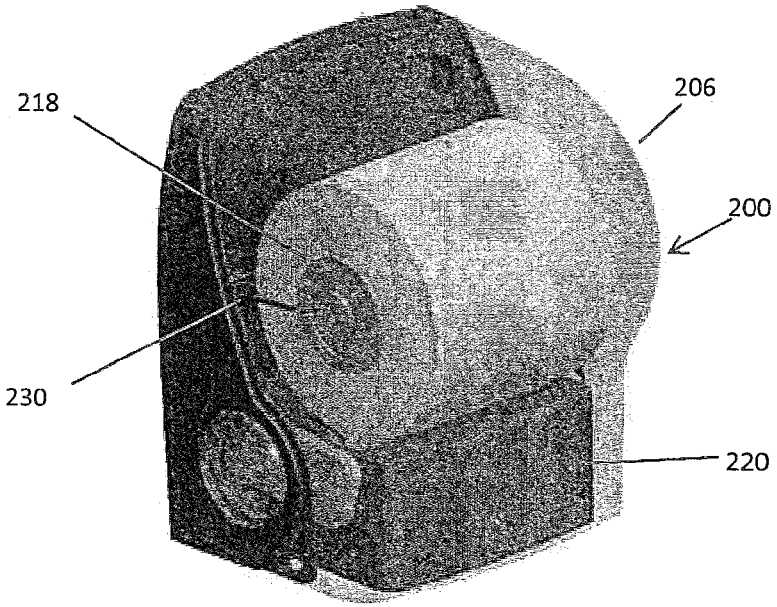
FIGS. 15A-15B illustrate an isometric view of an electronic residential dispenser with the cover closed and with the cover open in an alternate embodiment.
Figure 15B:
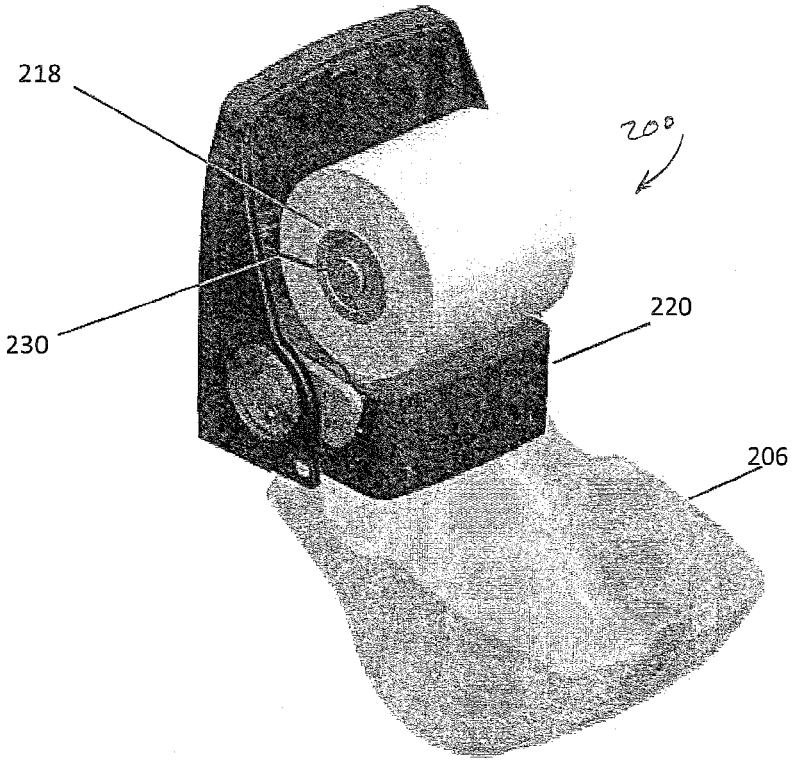

FIGS. 15A-15B illustrate an isometric view of the electronic residential dispenser 200 with the clear cover closed and with the clear cover opened. Both illustrations show the dispenser module 220, holder support mechanism 230 and the outer surface of paper holder arm 218.

Figure 16A:
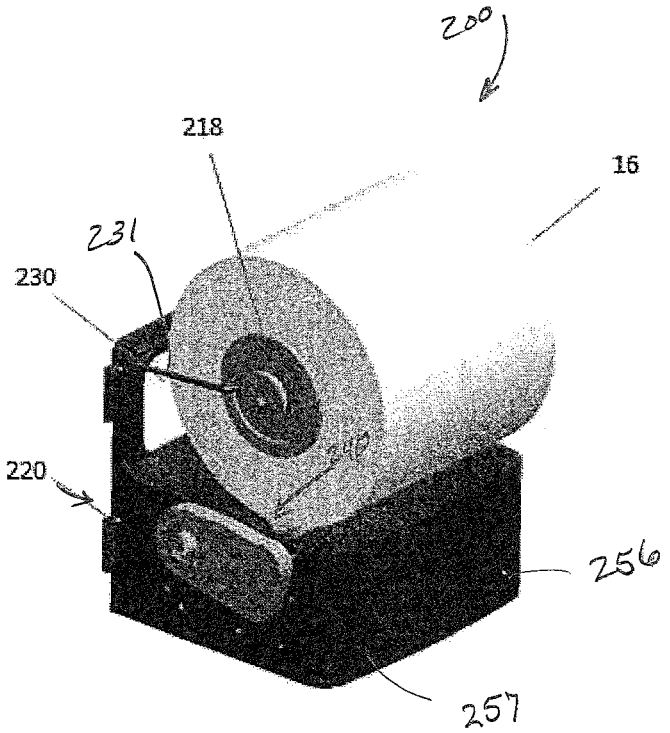
FIGS. 16A-16B illustrate a tissue roll support mechanism and a belt drive mechanism in an alternate embodiment.
Figure 16B:
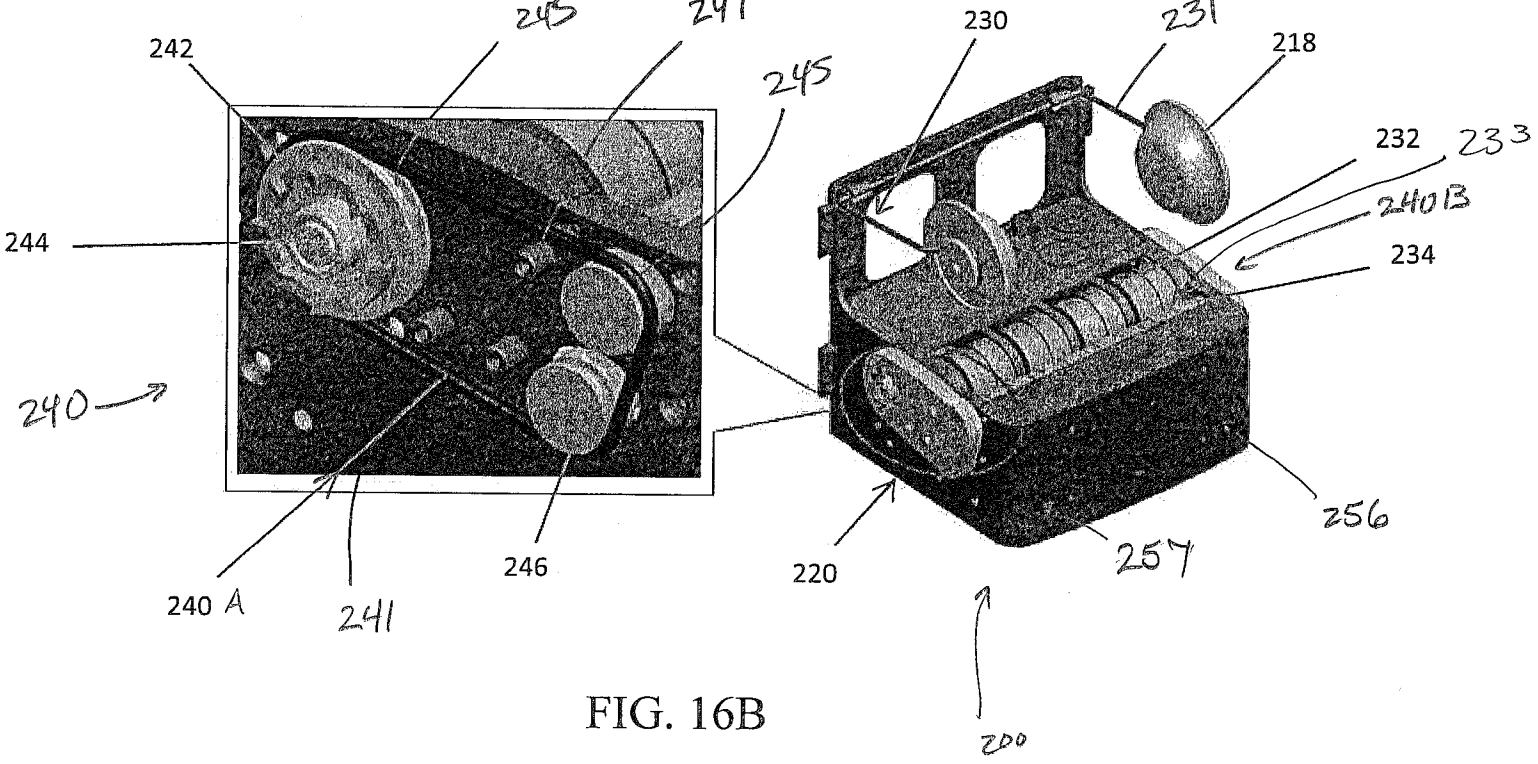

FIGS. 16A-16B illustrate the paper roll support mechanism 230 and a drive mechanism 240 therefor in further detail. For example, FIG. 16A shows a roll of tissue paper 16 wherein the paper roll 16 is mounted on paper holder arms 218. The paper holder arms 218 can include generally conically shaped members that can be formed of a reduced friction material to help assist in easy feeding of the paper from the roll. The paper holder arms 218, which may also be referred to as "hubs" 218 herein are attached to the dispenser module 220 frame by the roll holder support mechanism 230, shown in the present embodiment as including wire or similar supports 231 that can have a bias or resiliency to accommodate varying size rolls and to provide some amount of flex or giving as the paper is drawn from the roll, although other materials also can be used. FIG. 16B shows the paper holder arms 218 and roll holder support mechanism 230 in greater detail with the roll of paper removed, and further generally illustrates the arrangement of a driving roller 232 and pressing rollers 234 of the present embodiment, defining a paper feed passage 233 through which the paper sheet material is drawn during a feeding operation.

Also shown in the expanded portion of dispenser module 220 of FIG. 16B is the drive mechanism 240. The drive mechanism 240 can include one or more belt drive assemblies 240A/240B mounted on opposite sides of the dispenser. Each belt drive assembly 240A/240B including a drive belt 241 that is extended about grooves 245 defined or formed at the ends 246 of pressing rollers 234, about and received within a peripheral surface of external gears 242. The belts 241 also can be extended/engaged about gears, sprockets or other hub members mounted to the ends of the pressing rollers. The drive belts 241 generally can be formed of a substantially non-stretch, non-slip material to avoid reductions in driving traction, and alternatively could include a linkage of a plastic or synthetic material. A biased tension or take-up roller 249, also can be provided, with the drive belt extended thereabout, to help maintain tension in the drive belt during use. A motor 248 (shown in FIGS. 19 and 20) engages a driving roller 232 with the dual pressing rollers 234 being correspondingly driven with the operation of the drive roller 232 by the drive belt passing thereabout.

Figure 17A:
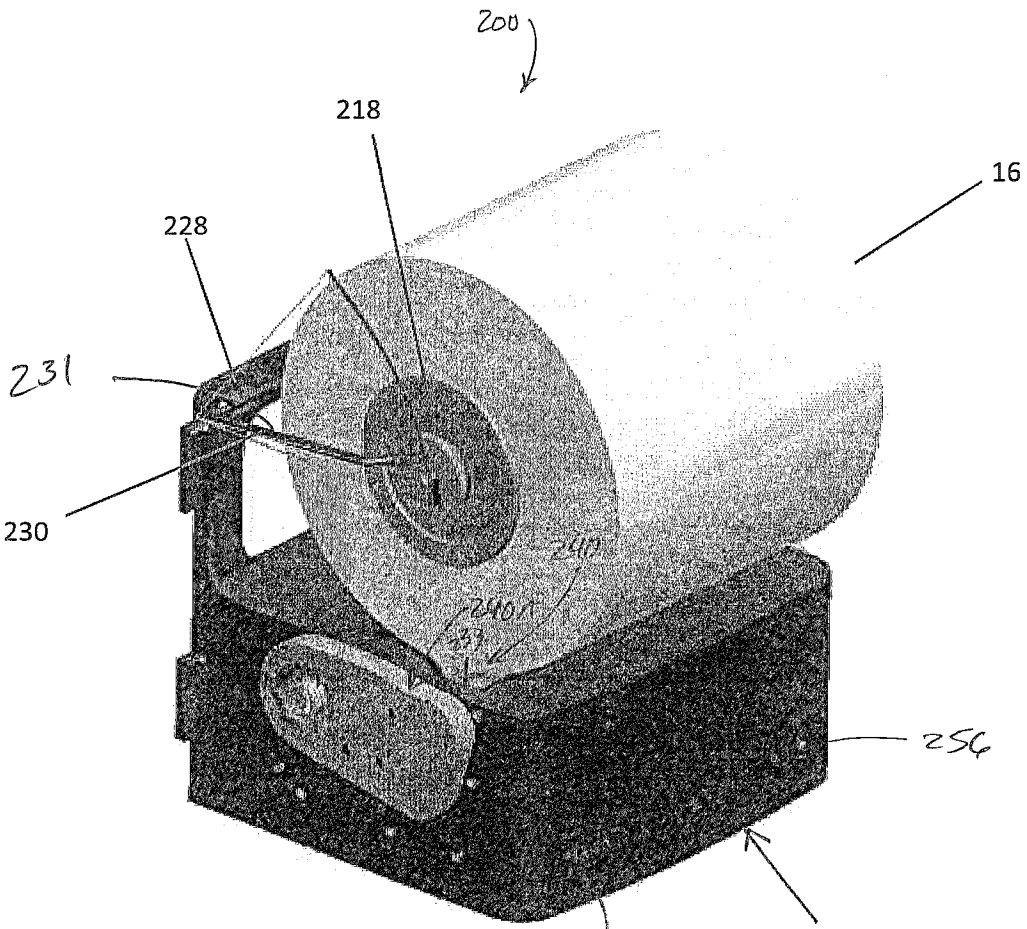
FIGS. 17A-17B illustrate front perspective and side elevation views of the electronic residential dispenser in an alternate embodiment.
Figure 17B:
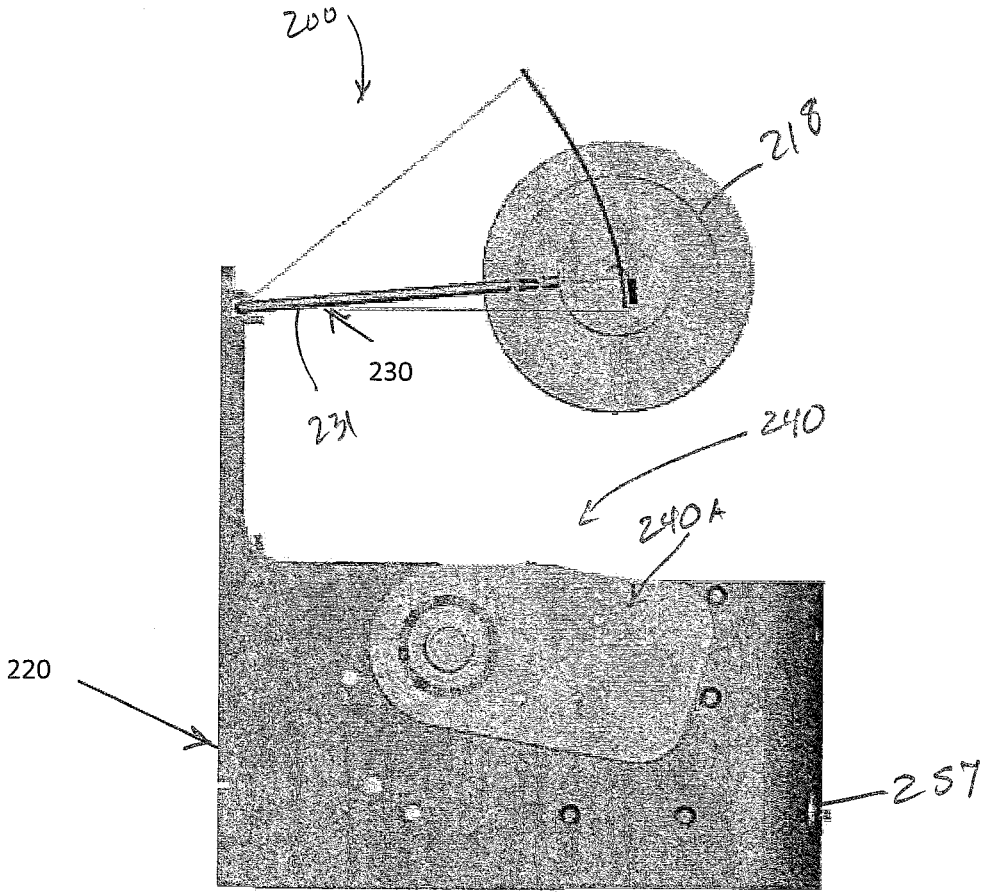

FIGS. 17A-17B illustrate further front perspective and side elevation views of the electronic residential dispenser of the present embodiment. The front perspective view of FIG. 17A shows a full roll of tissue paper 16 mounted on paper holder arms 218 by roll holder support mechanism 230 which is attached to the dispenser module 220 frame by brackets 228. The paper in this illustration feeds into and is driven directly by the driving roller 232 and the pressing rollers 234. FIG. 17B shows the range of motion for the roll holder support mechanism 230 during the dispensing of a full roll of paper.

Figure 18A:
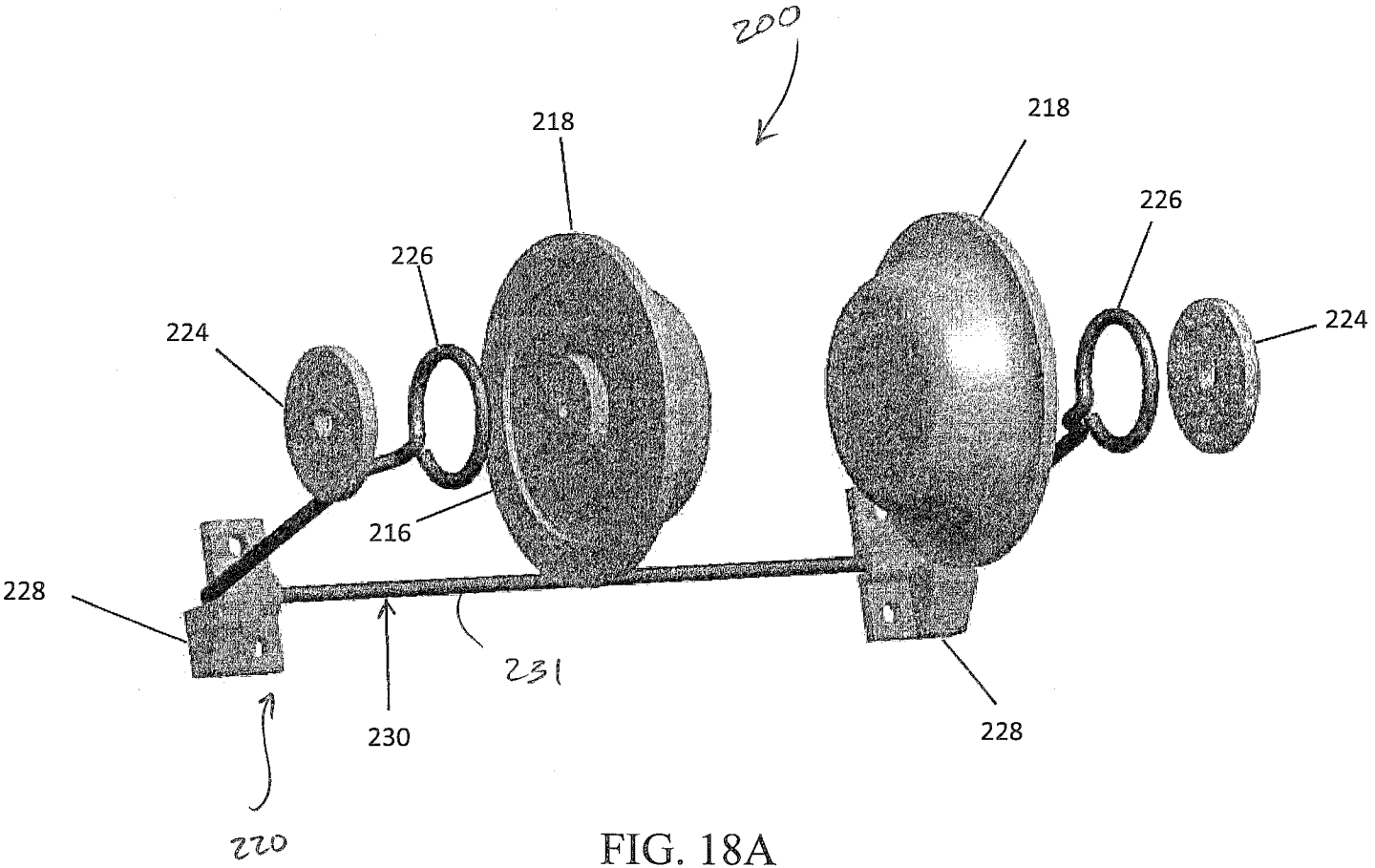
FIGS. 18A-18B illustrate the paper holder arms and wire holder support in greater detail in an alternate embodiment.
Figure 18B:
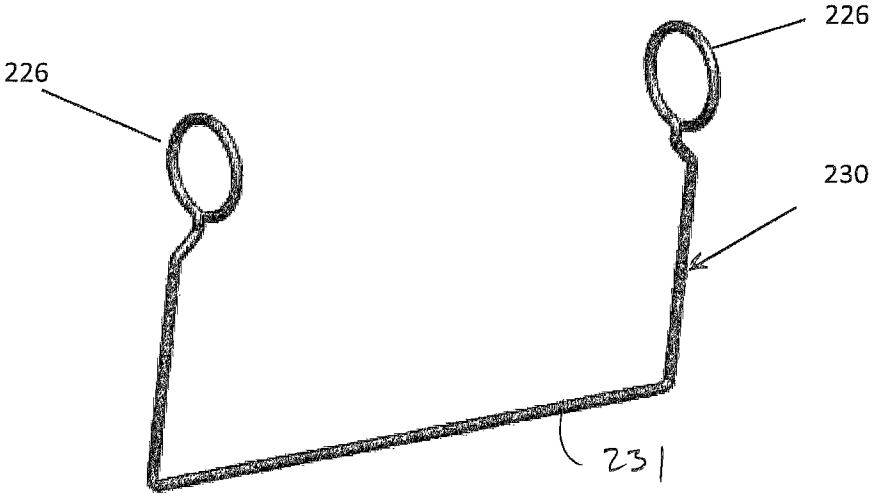

FIGS. 18A-18B illustrate the paper holder arms (hubs) 218 and roll holder support mechanism 230 in greater detail. The rear section of roll holder support mechanism 230 is secured to the back of the dispenser module 220 by brackets 228. The two sides of roll holder support mechanism 230 include circular clamps 226 at the ends thereof that fit over both roll holder supports 216 centered on the outer surface of paper holder arms 218. End supports 224 secure the circular clamps 226 to each roll holder support by a bolt or other attachment means.

Figure 19:
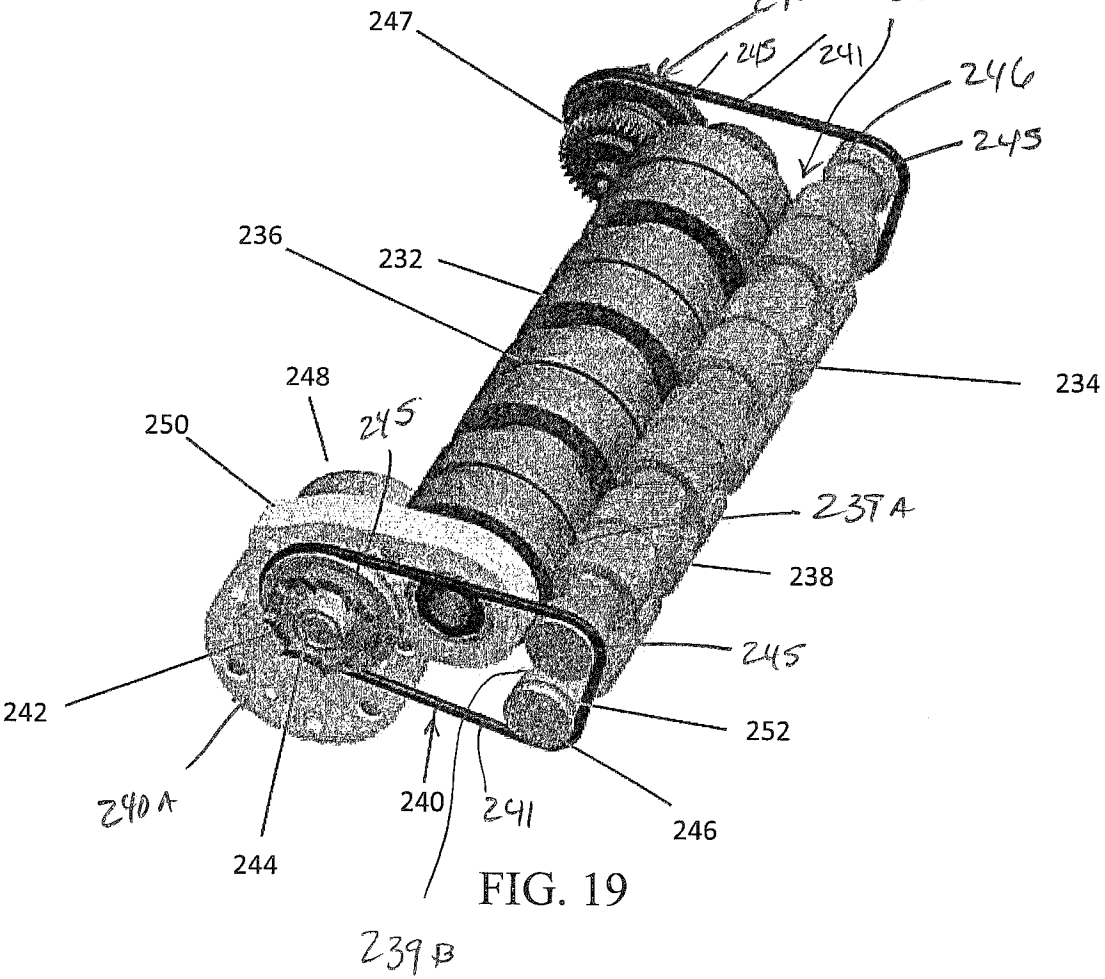
FIG. 19 illustrates operation of the belt-driven components of the electronic residential dispenser module in an alternate embodiment.

FIG. 19 further illustrates the drive mechanism 240 and belt-driven components of the electronic residential dispenser module, which generally performs substantially the same functionality as the embodiment of FIGS. 1-12. In this embodiment, the motor 248 is attached to a gear box 250, or transmission, for providing a driving force or power to the driving roller 232 to drive the rotation thereof. Also shown in FIG. 19 are drive belts 240 positioned over and received with the grooved surfaces 245 defined at the ends 246 of pressing rollers 234 and formed about the peripheral surface of belt drive hubs 242 at each side of the dispenser. The drive belts can be seated within the grooves 245 of the belt drive hubs 242 and pressing roller ends in a tensioned or substantially engaged, fitted arrangement to help maintain a consistent driving of the pressing rollers at a substantially equivalent or cooperative rate with the rotation of the driving roll for drawing or pulling the paper sheet through the feed passage 233. The drive belt driven operation of the pressing rollers in cooperation/conjunction with the operation of the driving roller of the present embodiment thus can provide for an enhanced, substantially consistent positive engagement and pulling of the sheet material through the feed passage between the driving and pressing rollers, which can help minimize the potential for tearing of the paper above the driving roller. The belt drive mechanism also can enable a reduction in noise generated by operation of the dispenser, which further can be less costly to produce and operate, while being suitable for use as a residential or commercial tissue or paper dispenser, and/or for use in other types of flexible sheet dispensers, without requiring substantial adjustments during the dispensing cycle to line up the paper perforations with a flapper bar or other cutting mechanism.

In the present embodiment, the driving roller 232 and pressing rollers 234 also can be fabricated from wood, which can reduce the cost of the rollers over the cost of using ABS plastic or rubber rollers, while enabling a positive engagement and drawing of the paper sheet material therebetween, and can further reduce the incidence of static electricity potentially being generated during feeding of the paper by the rollers. As FIGS. 19-20 indicate, the driving roller 232 could include grooves 236, and the pressing rollers 234 can include grooves 238, which serve to keep the paper from sliding on the rollers, i.e., from pulling to one side during operation. The grooves 236, 238 of the drive and pressing rollers are designed and spaced for keeping the paper from sliding on the rollers 232, 234 regardless of the material used for the rollers. The driving roller 232 and double pressing rollers 234 also can be machined to provide spacers between each section of the rollers. For example, the driving roller 232 can be machined into two-four sections (or more), each section separated from each adjacent section by a spacer or cut-out section. The pressing rollers 234 also can be machined into sections, (i.e., two-four or more sections) each having a length to match that of the corresponding section of the pressing roller 232 that each comes into contact with during dispensing operations. Each section of both the driving and pressing rollers further generally can include at least one groove machined midway in each section length.

As also shown in FIG. 19 the pressing rollers 234, generally will be mounted in a floating arrangement, positioned to engage the driving roller adjacent the upstream and downstream points or ends of the feed passage 233 defined between the driving and pressing rollers. The engagement of the driving and pressing rollers in this arrangement thus defines multiple nip or pressing points 239A/239B, whereby the paper sheet material is engaged between the driving and pressing rollers at multiple points as it is drawn through the feed passage. Such an arrangement of the dual pressing roller engaging the driving roller, which rollers further are positively driven by the drive belt arrangement in a cooperative movement/rate with the driving of the driving roller helps maintain the positive engagement of the paper sheet material at multiple points, and thus the substantially consistent feeding thereof.

As a result, the potential incidence of the tearing or breaking of the paper sheet material, such as along the tear lines or perforations thereof, is substantially reduced or minimized. In particular, the arrangement of the pressing rollers engaging the driving roller helps to substantially ensure that tearing or breaks in the paper will not occur above the driving roller, and, to the extent that such breaks or tearing were to potentially occur, that the paper sheet material can continue to be fed by the dispenser without requiring the manual reloading or refeeding of the paper between the driving and pressing rollers, and without requiring the paper roll itself to be driven for dispensing the paper sheet material.

Figure 20:
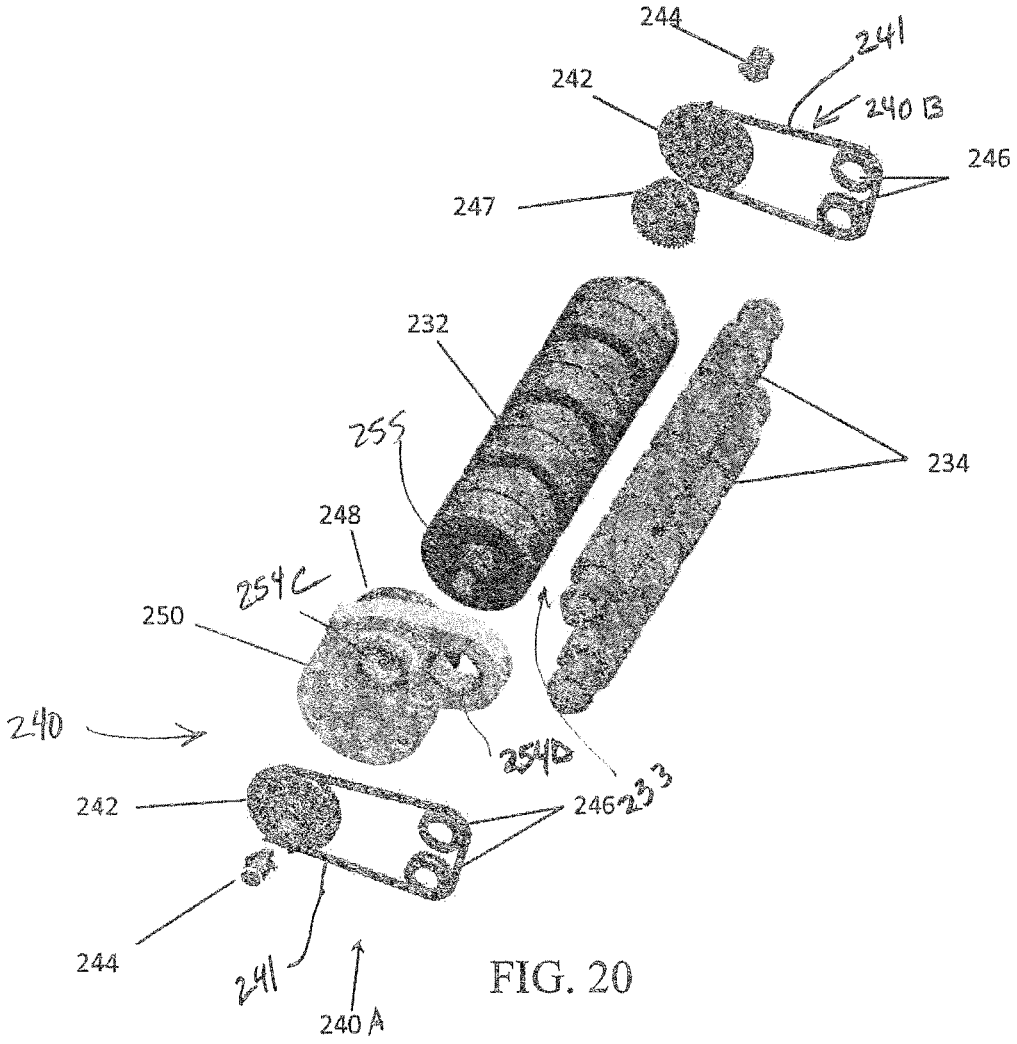
FIG. 20 illustrates an exploded view of the individual components of the dual pressing rollers, driving roller, and belt drive in an alternate embodiment.
Figure 21A:
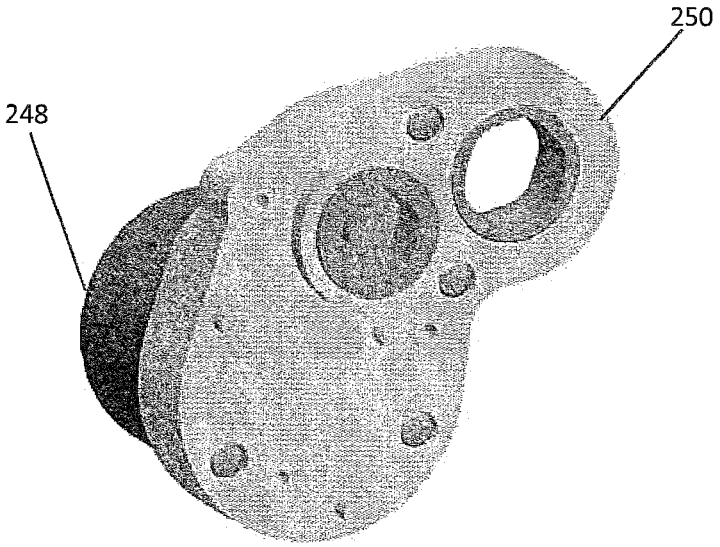
FIGS. 21A-21B illustrate the motor and gear mechanism for the belt drive in an alternate embodiment.
Figure 21B:
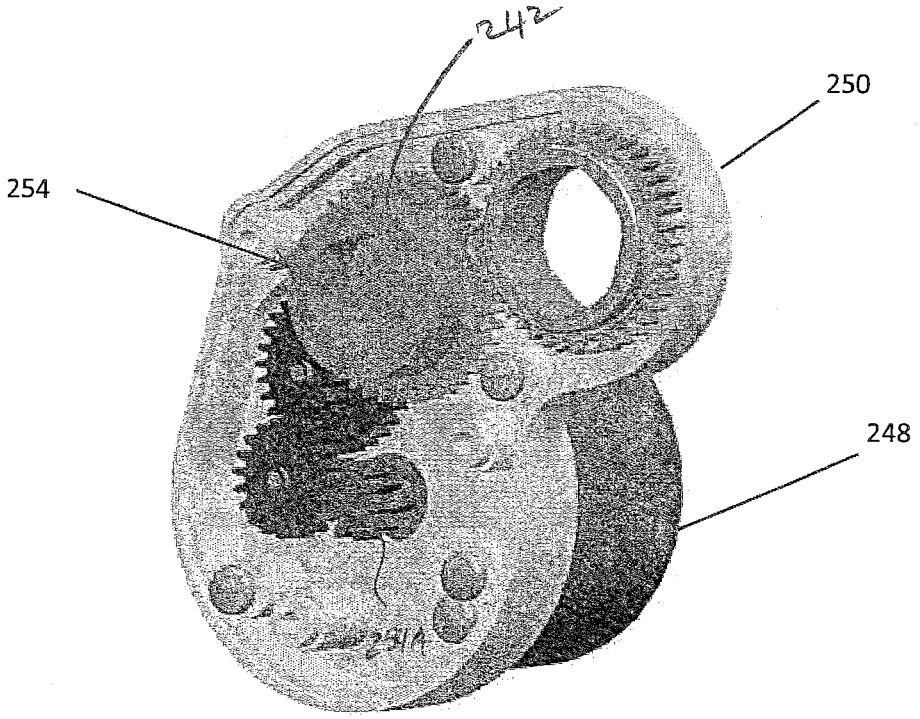

FIG. 20 illustrates an exploded view of the individual components of the drive mechanism 240, including the dual pressing rollers 234, driving roller 232, and the drive belt arrangements 240A/240B, on opposite sides thereof for driving the pressing rollers in a cooperative movement/rate with the driving of the driving roller so as to provide a resilient, controlled, positive engagement of the paper sheet material. FIGS. 21A-21B illustrate the motor and drive belt arrangement 240A on the drive side of the dispenser. FIG. 21A shows a general example configuration of the transmission/gear box 250 and motor 248. FIG. 21B shows the interior of gear box 250. As indicated in FIG. 21B, the drive mechanism can include a plurality of intermeshing gears 254, including a motor drive gear 254A connected to and driven by the motor 248, transmission gears 254B, belt drive gear 254C, and a driving roller hub gear 254D through which an end 255 (FIG. 20) of the driving roll 232 is received. As the motor is actuated, it drives the gears of the gear box 250, which in turn transmit this driving force to the belt drive gear 254C and driving roller hub gear 254D for operation of the pressing rollers (via the drive belt) and the driving roller.

In operation of the dispenser, the motor drives its drive gear 254A (FIG. 21B) in response to a signal, such as from the user pressing a button or switch 256 (FIGS. 16A-17A) or from a sensor 257 detecting a user. The rotation of the motor drive gear generates a driving force that is transmitted via the gear arrangement to the belt drive gear 254C, to which a belt drive hub 242 is mounted, and to the hub gear 254D, mounted to the driving roller to drive rotation of the driving roller 232. On the opposite side of the dispenser, the rotation of the drive roller causes rotation of a corresponding belt drive hub 242. Rotation of the belt drive hubs 242 in turn drives the pressing rollers by the drive belt extended about the grooves at the ends thereof. As a result, the driving and pressing rollers are cooperatively actuated and driven for a predetermined time, number of cycles or revolutions of the rollers, or otherwise as needed to feed a desired amount of the paper sheet material therebetween.

In the electronic dispenser, a sensor may be provided to detect an object placed in a detection zone external to the dispenser. This sensor may be a passive sensor that detects changes in ambient conditions, such as ambient light, capacitance changes caused by an object in a detection zone, and so forth. In an alternate embodiment, the sensor may be an active device and include an active transmitter and associated receiver, such as one or more infrared (IR) transmitters and an IR receiver. The transmitter can transmit an active signal in a transmission cone corresponding to the detection zone, and the receiver detects a threshold amount of the active signal reflected from an object placed into the detection zone. Control circuitry within the housing is configured with the sensor for initiating a dispense cycle upon a valid detection signal from the receiver.

The dispenser control circuitry controls activation of the dispensing mechanism upon valid detection of a user's hand for dispensing a measured length of the sheet material. Sensors and associated circuitry may be provided for this purpose. Various types of sensors are well known to those skilled in the art, including IR, radio frequency (RF), capacitive sensors, etc. Any one or a combination of such sensing systems can be used.

The disclosed embodiments provide a mechanism for automatically controlling the dispensing of paper products, for example, rolls of paper sheet materials such as paper towels or tissue paper, which further may be formed with perforations or tear lines so as to define sheets of a desired size. However, although the embodiments disclosed herein can be used in a system for dispensing paper towels and toilet tissue in facilities such as residential bathrooms and public restrooms, the concepts are applicable to other types of automatic paper dispensing and metering applications. The embodiments disclosed herein are particularly suited for use in buildings such as hotels and hospitals having a private bathroom in each room and distributed over multiple floors in which an electronic dispensing network detects and reports empty dispensers, paper levels, paper jams, power levels, losses, and vandalism. Real time monitoring of each dispenser in the system allows total control of an entire facility's bathroom/restroom paper requirements.

In a network environment, each dispenser control can have a data communications network interface. The network allows the dispenser status to be monitored on a continuous basis from any number of remote terminals, including handheld computing devices. This ability to monitor the usage and status of each paper dispenser yields greater user satisfaction. The custodial staff can maintain the dispenser in proper service condition with minimal down time by having instant notification of paper outages or malfunctions. Although clearly beneficial in a hotel or restaurant environment, a large home having multiple bathrooms could also benefit from a local area network to monitor paper usage and dispenser status.

Each dispenser with its associated network interface and application program forms one device within a bi-directional local communications network. Connection to this network can be via one or more media types; e.g., wire, radio frequency (RF) or infrared (IR). The dispenser status and monitored values are converted to digital form and the data is transmitted via the network. Additionally, configuration parameters for the operation of the dispenser can be received via the network. A collection of dispensers communicates over this network to a master network device (e.g., 136 in FIG. 22) that acts as the server for the local network. The master device interprets the data and manipulates it for rebroadcast to a separate and independent building automation network. The master device thus acts as a gateway between the local dispenser network and any other network protocol. The master device can also broadcast to a handheld computing device using the same or different network media type.

Figure 22:
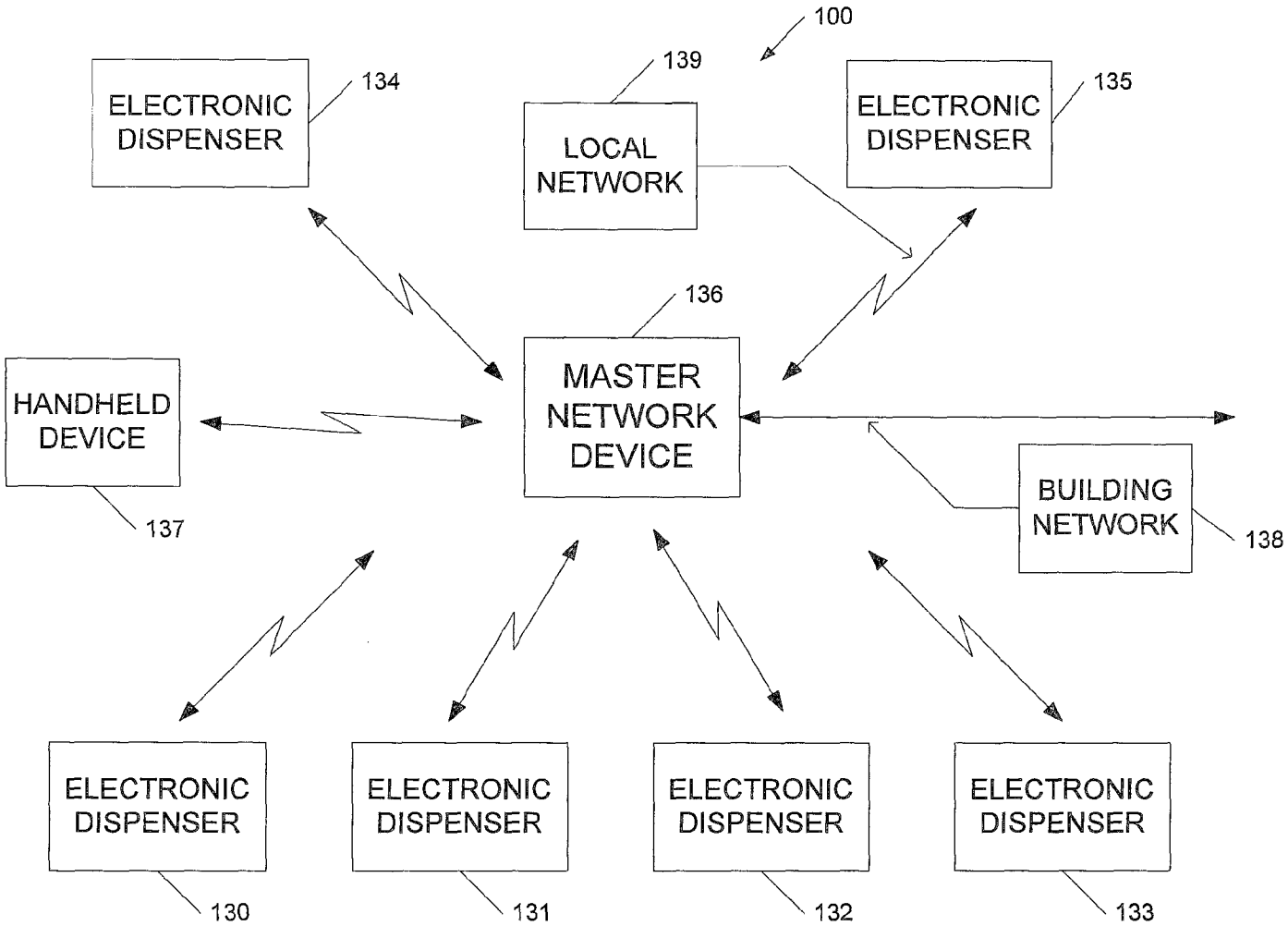
FIG. 22 illustrates the layout of an electronic dispenser network system 100 for automatic monitoring and dispensing in an exemplary network embodiment.

FIG. 22 systematically illustrates one embodiment of a layout of the electronic dispenser network 100 for automatic monitoring and dispensing in an exemplary network embodiment. This layout exemplifies a simple installation scenario, although other, more complex arrangements and combinations are possible and within the scope of the invention. The electronic dispenser network 100 is a collection and combination of the electronic dispensers 130-135, master network device 136, and handheld device 137. This collection of electronic dispensers 130-135 and master network device 136 forms a local dispenser network 139 and can be confined to a specific floor or other area requiring the dispensing system. With the selection of the appropriate communications medium, rooms on other floors of the building can be included in separate local networks. Multiple local electronic dispenser networks 100 can be coupled to a building communications network 138 through the master network devices 136.

The network communications medium (i.e., the data signal path) between the master network device 136 and the dispensers 130-135 can be wire, radio frequency (RF) or infrared (IR). The network medium is selected to yield the highest network performance given the architectural construction and limitations of the space. The communications protocol used with the local dispenser networks can be a proprietary method or one of many recognized standard protocols.

A personal digital assistant (PDA) 137 or similar device with a supported transceiver can be used to retrieve data from any floor, area, and room having a master network device 136. The handheld device 137, such as a PDA, is brought within transmission distance of the master network device 136. Bi-directional communications is possible to download current dispenser status and upload dispenser operational parameters.

Figure 23:
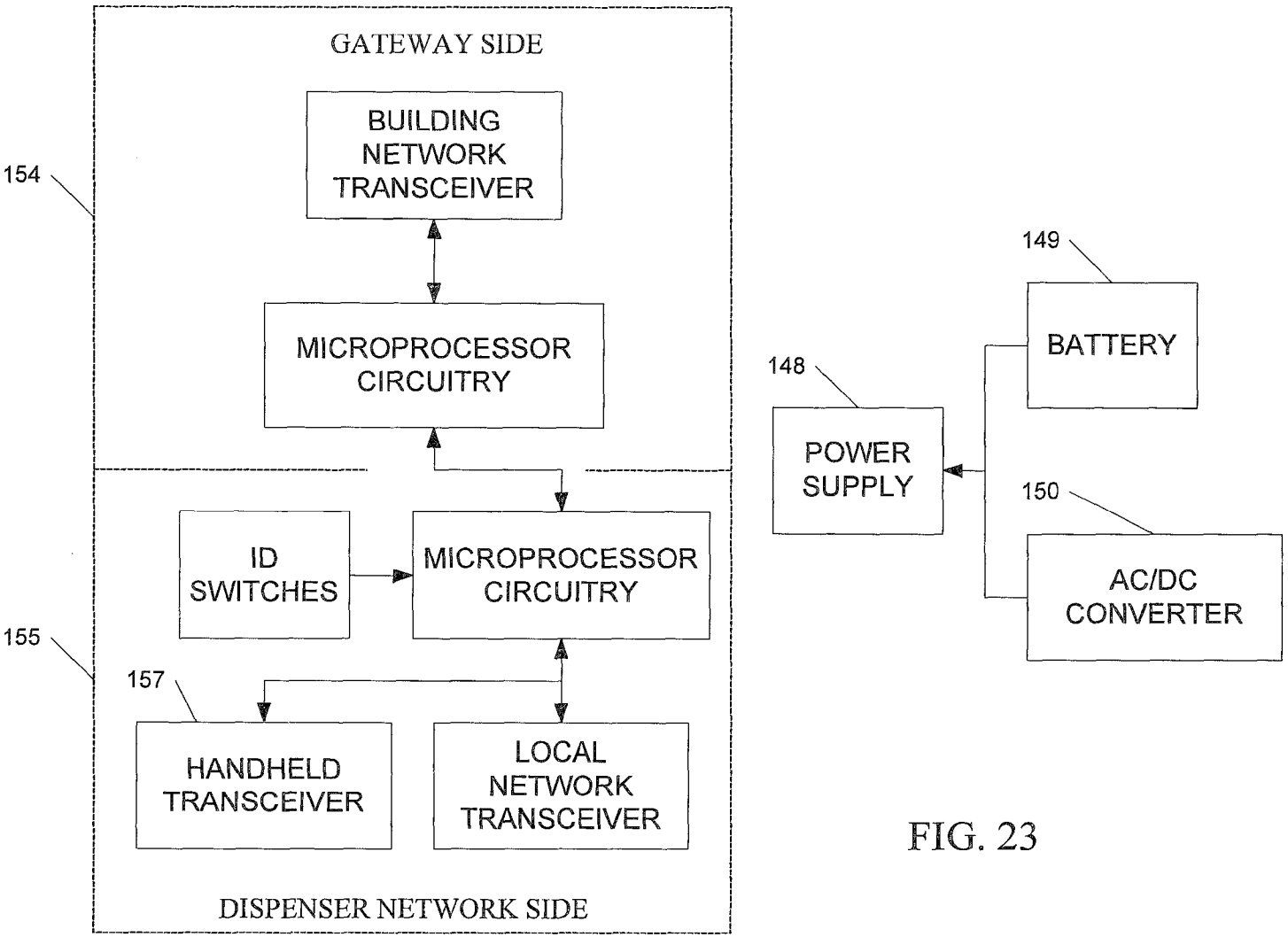
FIG. 23 illustrates a block diagram of a master network device for the electronic dispensing system in an exemplary network embodiment.

The electronic dispensing network system 100 includes a master network device 136 that can be attached to a ceiling plane or in close proximity to the group of dispensers 130-135. It is situated to yield the best signal strength when using RF or IR transceivers. The master network device 36 provides the common data collection point (the server) for the dispenser units 130-135 located in each local network area 139. FIG. 23 illustrates, in block diagram form, the components of the master network device 136. One section of the master network device 136 is the network server 155 for the local electronic dispenser network. This processor is responsible for requesting and receiving dispenser status and parameter data sent via the local network 139. The transmitted data is interpreted and presented to a second processor 154 which forms a gateway connection to the building communications network 138. The primary purpose of the gateway is to convert one communications protocol to another. With this method of interfacing different networks, the electronic dispenser network can be adapted to support existing and future standard networks commonly used in building communications networks.

Another feature of the master network device 136 is a separate transceiver 157 to support use of a handheld computing device 137. This device can be a PDA, portable computer, or other display/keypad terminal. The communication medium between the master device network 136 and the handheld device 137 can be of a non-contact nature; such as RF or IR, or can be by a wired method, such as an Ethernet network interface or RS-232 connection. The medium and protocol can be different from that of the electronic dispenser network 100 and building communications network allowing greater flexibility in selecting a handheld device 137 to meet specific end-user needs.

Figure 24:
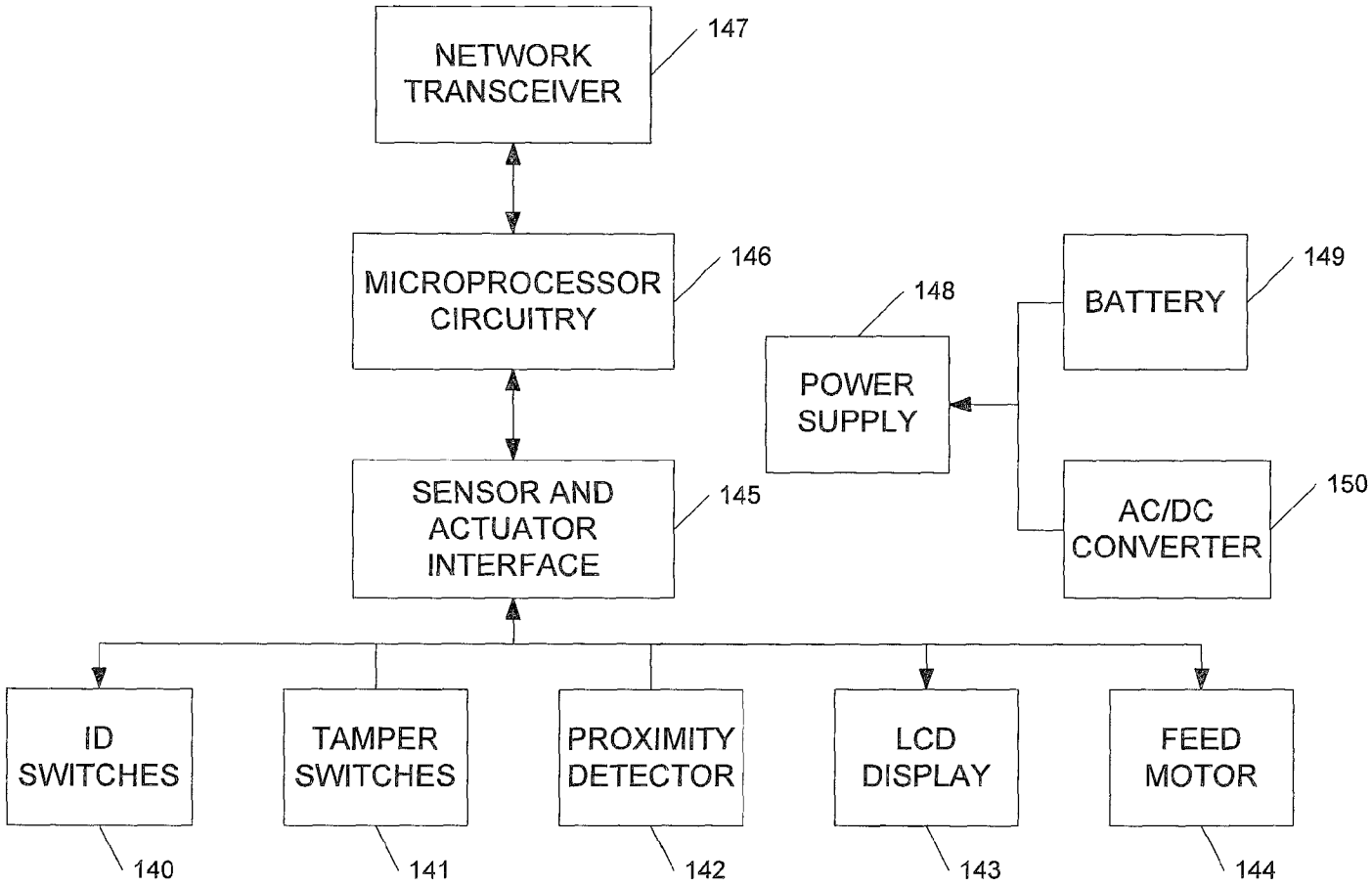
FIG. 24 illustrates a block diagram of an electronic dispenser control system in an exemplary embodiment.

The electronic control system (controller) illustrated in FIG. 24 is responsible for controlling, monitoring, and reporting the operation of the dispensers 130-135. A microprocessor 146 executes an application specific program. The processor has interface circuitry 145 to adapt the signals of the dispenser sensors and actuators, converting these control signals to the proper voltage levels. The sensors 140, 141, 142 represent a collection of input devices in a building network environment used to detect a user request for paper, measure the length of paper fed, sense the position or misfeed of the paper, enter a setting for the dispenser network address, and detect unauthorized opening or tampering of the enclosure. The actuators represent a collection of output devices to operate the feed roller motor 144, and output textual status messages to an LCD display 143. The transceiver circuit 147 provides the interface between the local network medium (wire, RF, or IR) and the voltage levels of the microprocessor 146. A power supply 148 is used to convert either main current and/or battery power to the appropriate levels for the electronic circuitry.

Figure 25:
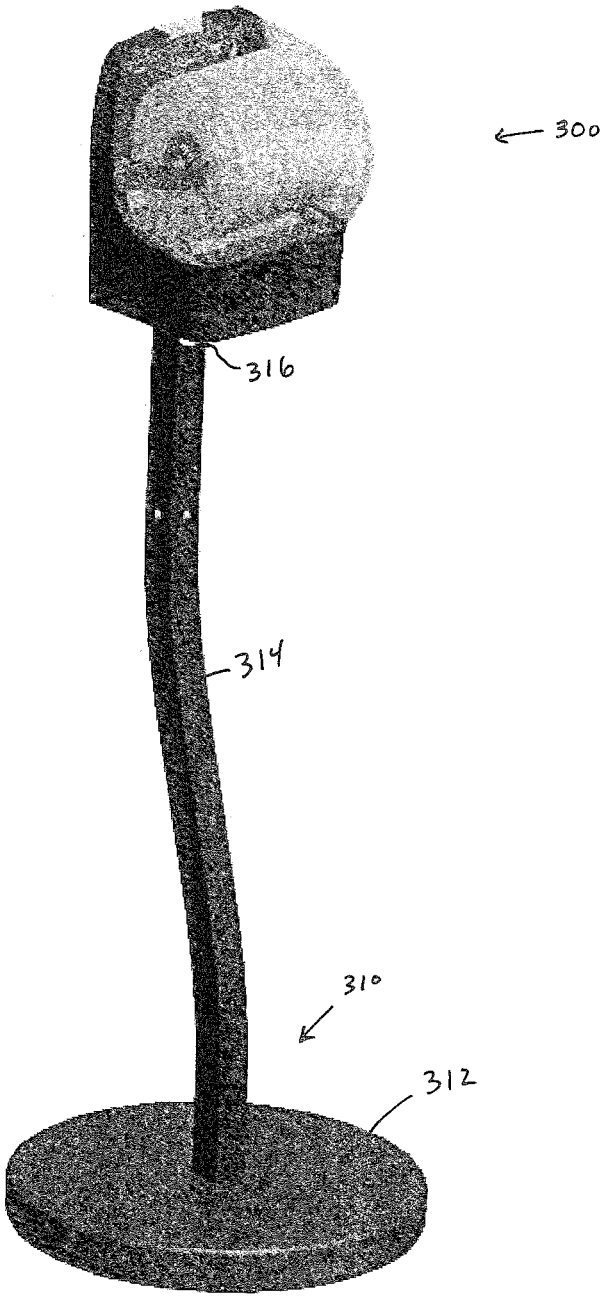
FIG. 25 illustrates an additional embodiment of an electronic residential dispenser module mounted on a pedestal.

FIG. 25 illustrates another alternative embodiment of an electronic sheet material dispenser 300, shown here as mounted or disposed on a pedestal 310 in a stand-alone type arrangement. As shown in FIG. 25, pedestal 310 includes a base 312 connected to the electronic residential dispenser 300 by way of leg 314. Leg 314 is connected at 316 to the electronic residential dispenser 300. The pedestal 310 shown in FIG. 25 is provided for exemplary purposes only, and should not be limiting in any manner. Accordingly, the base 312, leg 314, and attachment 316 can be modified in any manner that would provide support for the electronic residential dispenser 300 to secure the dispenser 300 in an elevated position away from base 312.

FIGS. 26A and 26B illustrate an isometric view of the electronic residential dispenser 300 of the embodiment shown in FIG. 25 with the clear cover closed and with the clear cover opened. Also, FIGS. 26C and 26D illustrate isometric views of the electronic residential dispenser 300 with the clear cover closed and the clear cover opened and the alternative embodiment of FIG. 25. The clear cover opens up in FIGS. 26C and 26D, while the clear cover hinges down in the embodiment shown in FIGS. 26A and 26B. When opened as shown in FIGS. 26B and 26D, a roll of paper 316 is shown mounted on paper holder arms 318. Also shown in FIGS. 26A-26D are manual button 315 and low power light 317. The manual button 315 allows a user to direct the electronic residential dispenser 300 to dispense additional sheets off the roll 318, generally by sensing motion proximate the manual button 315 or by physical engagement of the button 315. The low power light 317 allows a user to be apprised of when the batteries 352 need replacing without removing the batteries 352 to check remaining power.

Figure 27:
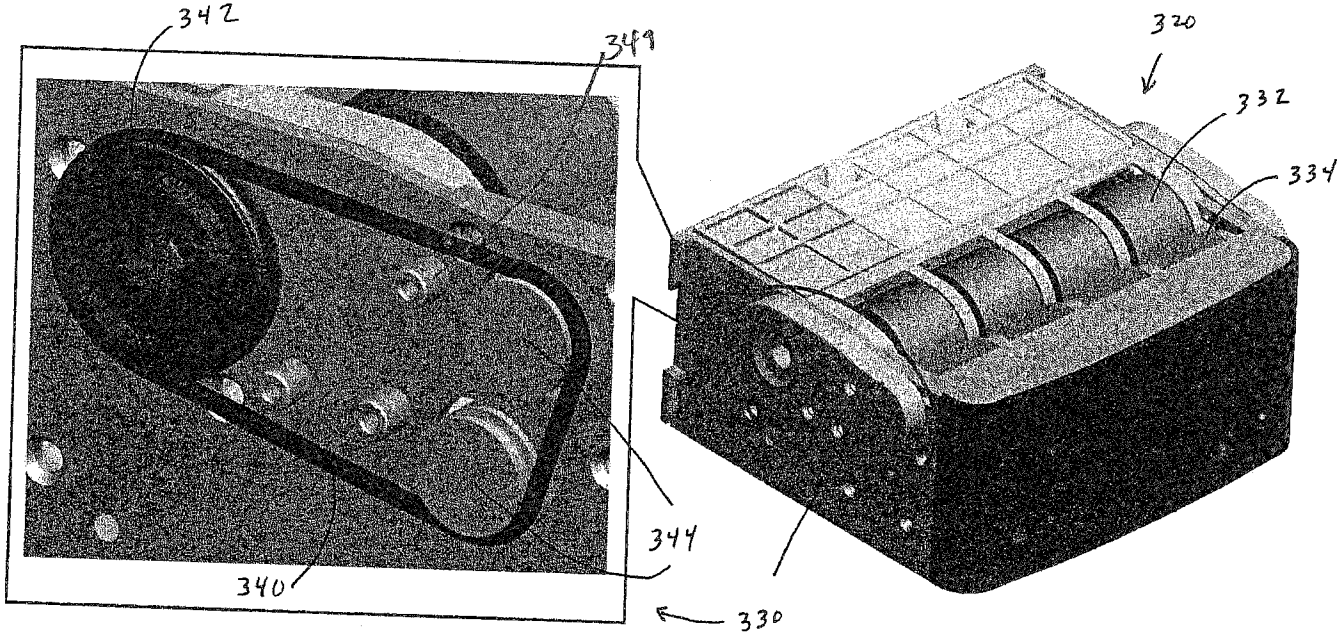
FIG. 27 illustrates a tissue roll support mechanism and a belt drive mechanism of the embodiment of FIG. 25.
Figure 33:
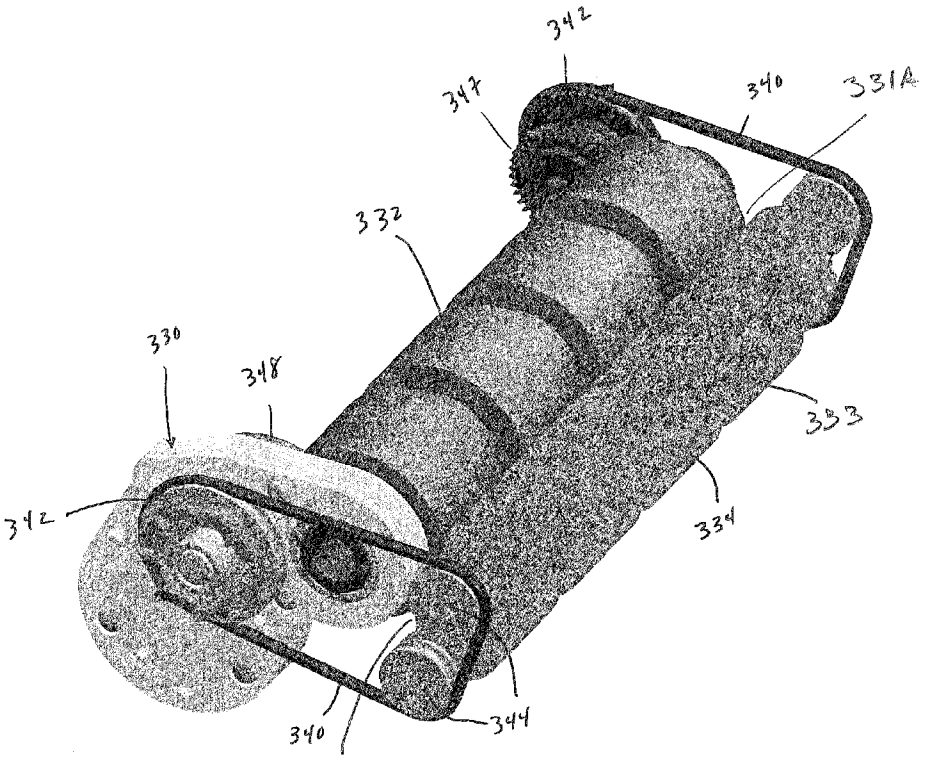
FIG. 33 illustrates the driving roller and dual press rollers in physical contact with each other in the embodiment shown in FIG. 25.

FIG. 27 illustrates dispenser module 320 and belt drive mechanism 330. The dispenser module 320 includes a driving roller 332 and dual pressing rollers 334 mounted in a floating arrangement, in pressing engagement with the driving roller at nip or engagement points 331A/331B along a feed passage 333 for the paper defined therebetween, as indicated in FIG. 33, so as to positively engage the paper sheet material therebetween. A motor 348 (shown in FIG. 31) operatively engages driving roller 332 similar to that action as detailed in previous embodiments described above. Belt drive mechanism 330 includes drive belts 340 positioned/extended about the ends 334 of pressing rollers 334 and around the external surface of drive gears 342 adjacent the ends of the driving roller 332 for transmission of the driving force applied to the driving roller to the pressing rollers 334, similar to the belt drive arrangement 240 (FIGS. 19-21B).

Figure 28A:
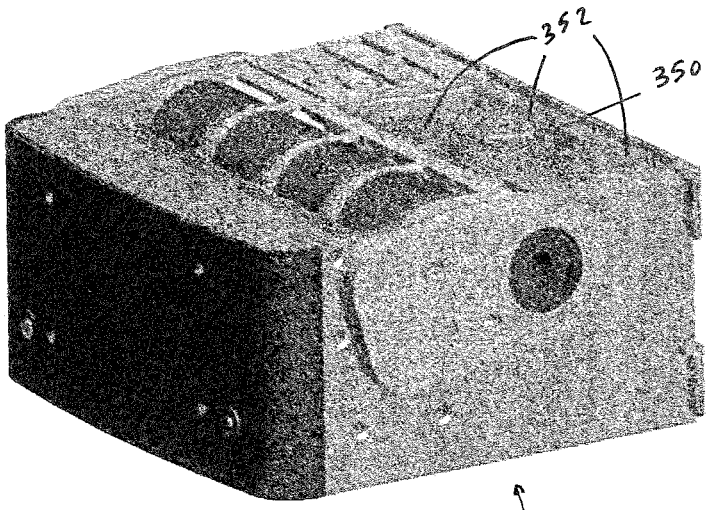
FIGS. 28A-28B illustrate the electronic residential dispenser module of the embodiment of FIG. 25 with the paper holder arms removed.
Figure 28B:
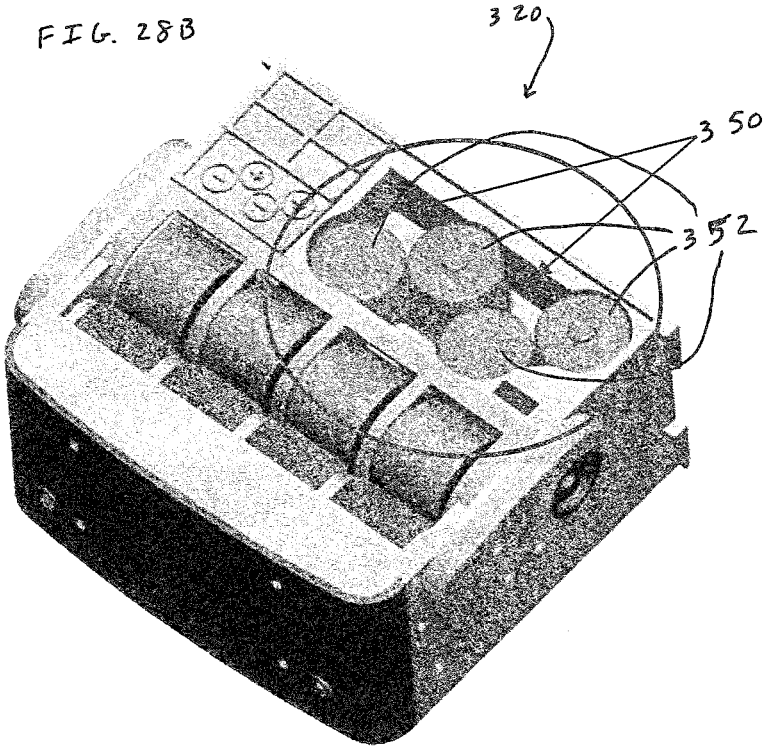

FIGS. 28A-28B illustrate the electronic residential dispenser module with the paper holder arms removed. As shown in FIGS. 28A and 28B, a battery compartment 350 is provided to house one or more batteries 352. The battery compartment 350 can alternatively be covered by a lid. In contrast to other embodiments, the battery compartment of the paper dispenser module 322 shown in this embodiment can be configured to allow the batteries 352 to be arranged in a staggered or nested arrangement to enable easier access to the batteries, as room is provided in the battery department 350 between the batteries 352, while also potentially enabling a reduction in size of the compartment.

Figure 29A:
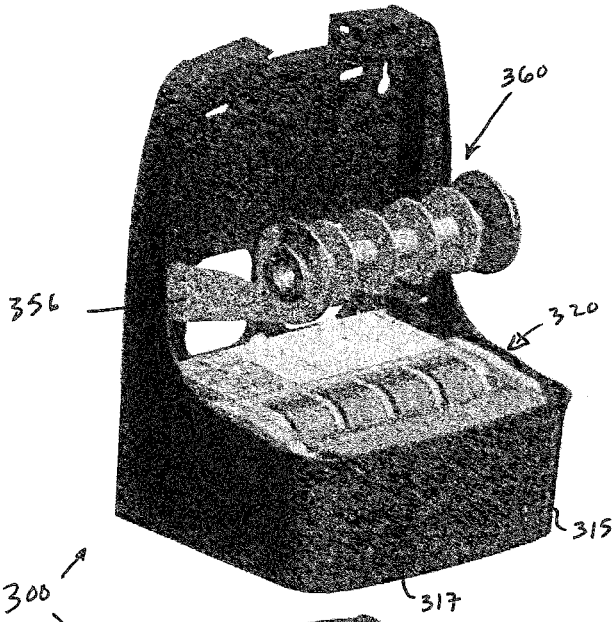
FIGS. 29A-29B illustrate front perspective views of the embodiment shown in FIG. 25 of the electronic residential dispenser without and with a paper roll.
Figure 29B:
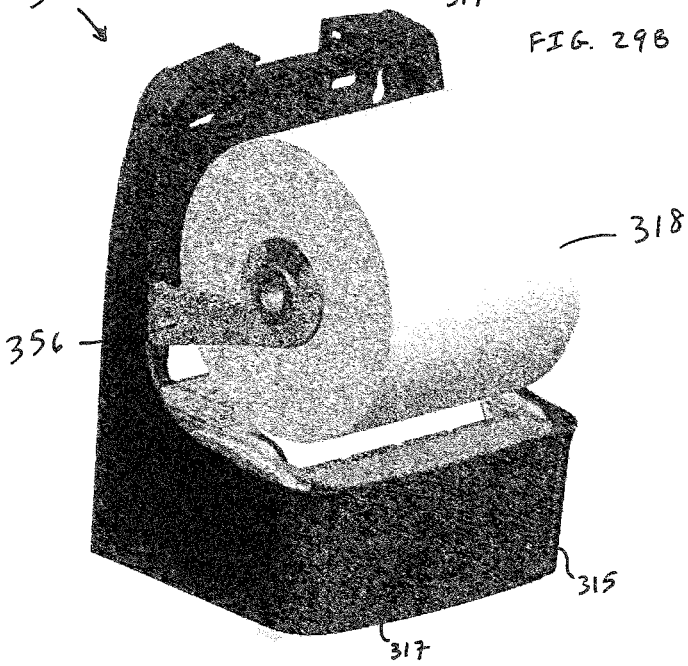

FIGS. 29A-29B illustrate the electronic dispenser module 300 with the roll of paper 318 installed (FIG. 29B) and with the roll of paper 318 installed (FIG. 29A). In contrast to previous embodiments, which included support mechanism (cf. 218 of FIGS. 16A-16B), the embodiment of FIG. 25 includes a bar module 354 upon which the core of the roller paper 318 can be disposed. As shown in FIG. 29A, roll support bar module 354 is disposable on paper roll support arms 356.

Figure 30:
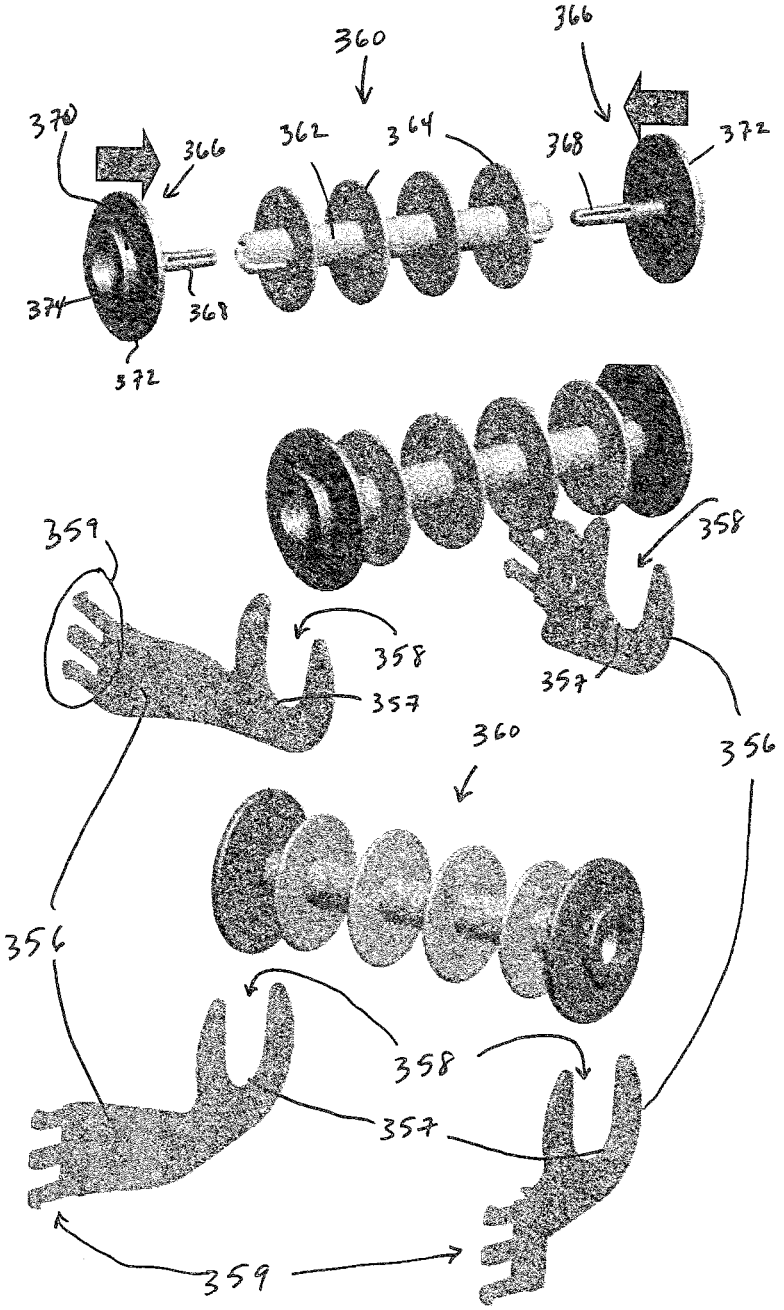
FIG. 30 illustrates an exploded view of the electronic residential dispenser module components of the exemplary embodiment shown in FIG. 25.

FIG. 30 illustrates an exploded view of the bar module 354, which includes a roll support module 360 that includes a main bar or axle 362 supporting the paper roll with a series of core spacers 364, which can include any number, mounted or formed therealong. Module 360 is attached at each end by an end module 366 or hub assembly. Each end module 366 can include a bar axle 368 adapted to extend into main bar 362 to attach end module 366 to a module 360. The end module 366 also includes end caps 372 each having an outwardly extending portion 374 having a receiving surface 370 thereabout that is sized to fit within a bar receiving slot 358 in one of the paper roll support arms 356 to enable the module 360 to be mounted to the paper roll support arms 356. In addition to the bar receiving slots 358, paper roll support arms 356 each can include a lower surface 357 at the lower end of bar receiving slot which engages the receiving service 370 of main bar module 360 in the embodiment shown in FIG. 30. The paper roll support arms 356 also include an arm attachment 359 which can be attached to a rear portion of the electronic dispenser module 300. In lieu of an arm attachment 359 as shown in FIG. 30, attachments other than that shown in FIG. 30 are within the scope of this invention.

Figure 31:
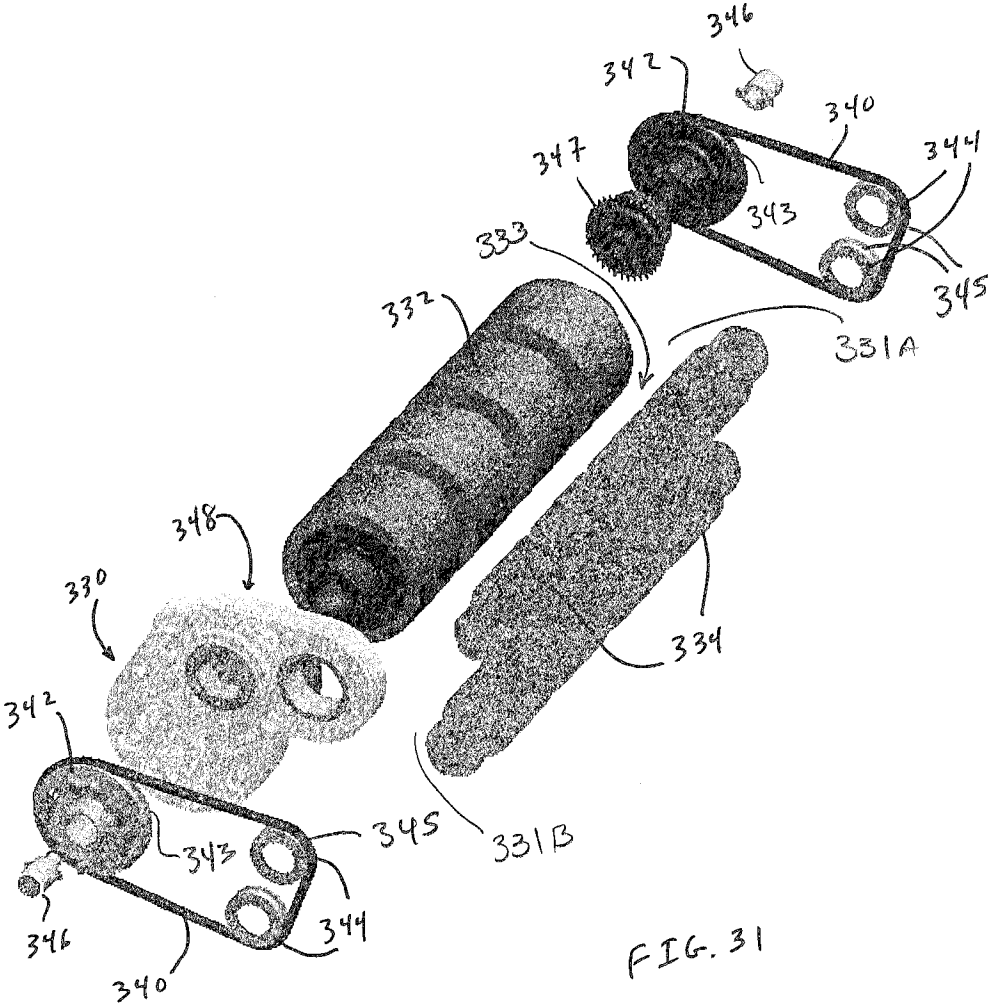
FIG. 31 illustrates an exploded view of the driving roller and dual press rollers of the embodiment shown in FIG. 25.

FIG. 31 illustrates an exploded view of the individual components of the dual pressing rollers 334, driving roller 332, and belt drive mechanism 330. FIG. 31 also shows motor 348 attached to the belt drive mechanism 330, with the motor 348 providing power to the driving roller 332. Belt drive mechanism 330 includes drive belt 340 positioned over grooved surfaces 245 of ends 344 of pressing rollers 334 and over a groove 343 of the external surface of gear 342. Also shown in FIG. 31, is an end cap 346 that secures within a central portion of gear 342. Gear 347 operates on the opposite side of the rollers, in coordination with gear 342 under control of motor 348.

Driving roller 332 and pressing rollers 334 also can be fabricated from wood which provide low static generation. Additionally, manufacturing the rollers from wood also reduces the cost of the rollers significantly from the cost of using ABS plastic or rubber rollers. The driving rollers 332 and dual pressing rollers 334 are machined to provide spacers between each section of the rollers. For example, as shown in FIG. 31, the driving roller 332 has been machined into four sections, each section separated from the adjacent section by a spacer (shown as a cut out). Other numbers of sections also can be used. The pressing rollers 334 have also been machined into four sections, each having a length to match that of the corresponding section of the pressing roller 332 that it comes into contact with during operation.

Figure 32A:
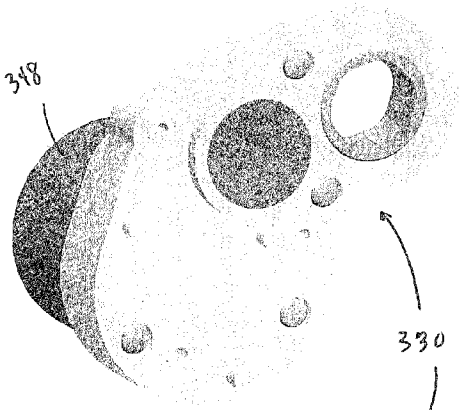
FIGS. 32A-32B illustrate the gear mechanism of the electronic residential dispenser module of in the embodiment of FIG. 25.
Figure 32B:
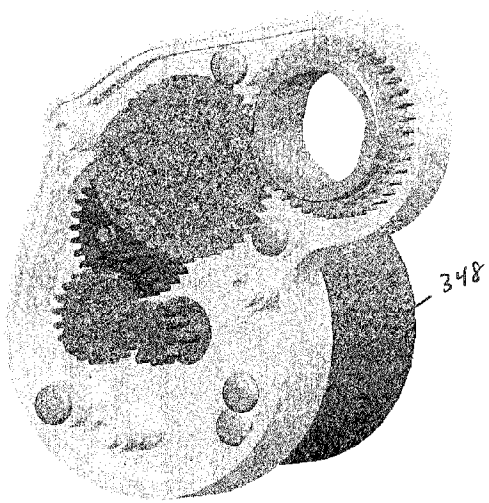

FIGS. 32A-32B illustrates the interior and exterior views of the belt drive mechanism 330. The gears shown within the interior of belt drive mechanism 330 (FIG. 32B) further can include any number of operational gears that function to dispense paper under influence of the drive from the motor 348. FIG. 32B further illustrates a transmission assembly 380, including a series of gears, including a motor drive gear 381 mounted to a drive shaft of the motor 348, idler/transmission gears 382, a belt drive gear, and a hub gear mounted to one end of the driving roller. The operation of the dispenser with the belt drive mechanism can be in a similar manner as discussed above with respect to FIGS. 13-24.

FIG. 33 illustrates the completed assembly of the driving rollers 332 and dual pressing rollers 334 arranged in physical contact with each other in the present embodiment, as well as illustrating the interaction between gears 347 and 342 under control of motor 348. As indicated, the dual pressing rolls are positioned to engage the driving roller so as to provide multiple points or areas of engagement (as indicated at 331A/331B) of the paper therebetween for drawing/feeding the paper along a feed path 333 and to a discharge of the dispenser. This arrangement of the rollers substantially retards or minimizes potential tearing or breakage of the paper, such as along/at perforations formed in the paper, at a point above the driving roller. The belt drive arrangement further provides for a substantially consistent pulling or drawing of the paper along the feed path between the driving and pressing rollers, which additionally can help avoid or reduce potential tearing. Still further, if such tearing does occur along the feed path, the paper generally can continue to be fed by the dispenser without requiring manual reloading or refeeding of the paper between the driving and pressing rollers, and/or requiring driving of the paper roll itself.

In an exemplary embodiment, all data can be configured using the BACnet communications protocol although this does not limit the invention in any way. Other communications protocols can be used as well and without restricting the invention in any way.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the present invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

What is claimed:

1. An automatic dispenser for dispensing a roll of a perforated paper product, the dispenser comprising:

a paper roll support upon which the roll of perforated paper sheets is disposed, the paper roll support including a plurality of paper holder arms attached along opposite sides of the paper roll support, and shaped to receive the paper roll therebetween;

a driving roller for unrolling the paper from the paper roll holder in response to a signal;

a series of pressing rollers, the pressing rollers each arranged so as to engage the perforated paper sheets against the driving roller as the driving roller is driven so as to draw the paper sheets along a feed path defined between the pressing and driving rollers and to a discharge; and a drive mechanism including a drive motor operatively connected to a belt drive gear and to at least one end of the driving roller, and at least one drive belt driven by the belt drive gear that engages the pressing rollers in a substantially tensioned arrangement to drive the pressing rollers with the driving roller so as to facilitate drawing of the perforated paper therebetween;

wherein the drive motor is actuated in response to a signal and drives the driving and pressing rollers for a predetermined number of cycles for feeding an amount of the perforated paper product from the roll.

2. The automatic dispenser of claim 1 wherein the driving roller and the pressing rollers are formed from wood to reduce static electricity.

3. The automatic dispenser of claim 1 wherein the driving roller includes a plurality of sections with each section separated from an adjoining section by a spacer section.

4. The automatic electronic dispenser of claim 1 wherein each pressing roller includes a plurality of sections with each section separated from an adjoining section by a spacer section.

5. The automatic dispenser of claim 1 wherein the drive belt comprises a non-slip material that substantially resists elongation, and wherein the belt drive gear and the plurality of pressing rollers comprise grooves formed about a periphery thereof within which the drive belt is received.

6. The automatic dispenser of claim 1 further comprising an electronic sensor located on a dispenser module for detecting the proximity of a user.

7. The automatic dispenser of claim 1, further comprising end caps with surfaces receivable in slots defined in each of the paper holder arms.

8. An automatic dispenser for dispensing a roll of a perforated paper product, comprising:

a paper roll support upon which the roll of perforated paper sheets is disposed, the paper roll support including a plurality of paper holder arms attached along opposite sides of the paper roll support, and shaped to receive the paper roll therebetween;

a driving roller for unrolling the paper from the paper roll holder in response to a signal;

a series of pressing rollers each arranged to engage the perforated paper sheets against the driving roller as the driving roller is driven to draw the paper sheets along a feed path defined between the pressing and driving rollers towards a discharge;

a drive mechanism including a drive motor operatively connected to a belt drive gear and the driving roller, and at least one drive belt driven by the belt drive gear and engaging the pressing rollers to drive the pressing rollers; and gearbox mechanism operatively connected to the drive motor and the driving roller to transfer power therebetween.

9. An electronic dispensing system for automatically dispensing and monitoring usage of a paper product, comprising:

at least one dispenser having a dispenser module for driving paper from a roll of the paper product through a discharge, the roll being disposed on paper holder arms, each dispenser module including:

a driving roller for unrolling the paper from a paper roll holder;

a pair of driven pressing rollers, the pressing rollers arranged to each engage the paper against the driving roller to assist in feeding the paper along a feed path between the pressing and driving rollers and to the discharge;

a drive belt extended about a peripheral end of each of the pressing rollers; and a drive motor operatively connected to a transmission arrangement for driving the driving roller and for driving the drive belt that engages the pressing rollers to be driven in cooperative movement with the operation of the driving roller to substantially maintain engagement of the paper at multiple points thereby facilitating feeding of the paper, wherein the drive motor is activated in response to a signal from a sensor so as to drive the driving roller and the pressing rollers to feed the paper from the roll.

10. The electronic dispensing system of claim 9 wherein the at least one dispenser comprises a plurality of dispensers, each of which further comprises a microprocessor controller and a transceiver.

11. The electronic dispensing system of claim 10 further comprising:

a master network device operatively connected with the transceiver in each dispenser; and a local network for enabling a paper product status message to be transmitted from each dispenser to the master network device.

12. The electronic dispensing system of claim 11 further comprising an automation and control network interoperable with the local network for monitoring a status of each dispenser.

13. The electronic dispensing system of claim 12 wherein the master network device receives status messages from the transceiver in each dispenser and transmits status messages over the automation and control network.

14. The electronic dispensing system of claim 11 wherein the microprocessor controller for each dispenser determines an amount of paper remaining on the paper roll holder mechanism and transmits a status message signal containing a status of the paper product to the master network device.

15. The electronic dispenser of claim 9 wherein the driving roller and the driven pressing rollers are manufactured from wood to reduce static electricity.

16. The electronic dispenser of claim 9 wherein the driving roller includes a plurality of sections with each section separated from an adjoining section by a spacer section.

17. The electronic dispenser of claim 9 wherein each pressing roller includes a plurality of sections with each section separated from an adjoining section by a spacer section.

18. The electronic dispenser of claim 9 wherein the drive belt comprises a non-slip material that substantially resists elongation, and wherein the belt drive gear and the plurality of pressing rollers comprise grooves formed about a periphery thereof within which the drive belt is received.

19. The electronic dispenser of claim 9 wherein the transmission comprises a gearbox mechanism including a plurality of intermeshing gears.

* * * * *